United States Patent [19]

Haynes

[11] 3,986,556

[45] Oct. 19, 1976

[54] HYDROCARBON RECOVERY FROM EARTH STRATA

[76] Inventor: Charles A. Haynes, 3308 Tipps Drive, Nederland, Tex. 77627

[22] Filed: Jan. 6, 1975

[21] Appl. No.: 538,591

[52] U.S. Cl. ..... 166/251; 166/260; 166/261; 166/272

[51] Int. Cl.[2] ..... E21B 43/24

[58] Field of Search ..... 166/260, 261, 256, 259, 166/263, 307, 308, 272, 250–252

[56] References Cited

UNITED STATES PATENTS

| | | | |
|---|---|---|---|
| 2,804,146 | 8/1957 | Crawford | 166/260 |
| 2,862,557 | 12/1958 | van Utenhove et al. | 166/256 X |
| 3,004,595 | 10/1961 | Crawford et al. | 166/245 |
| 3,072,187 | 1/1963 | Carr | 166/261 X |
| 3,127,935 | 4/1964 | Poettmann et al. | 166/260 |
| 3,136,361 | 6/1964 | Marx | 166/308 |
| 3,150,715 | 9/1964 | Dietz | 166/261 |
| 3,171,479 | 3/1965 | Parrish et al. | 166/261 |
| 3,196,945 | 7/1965 | Craig, Jr. et al. | 166/261 |
| 3,266,569 | 8/1966 | Sterrett | 166/263 |
| 3,369,604 | 2/1968 | Black et al. | 166/261 |
| 3,504,747 | 4/1970 | Vogt, Jr. et al. | 166/307 |

*Primary Examiner*—Stephen J. Novosad
*Attorney, Agent, or Firm*—William E. Kinnear

[57] ABSTRACT

A catalytic process for stimulating the recovery of hydrocarbons from porous and permeable hydrocarbon bearing strata in earth formations utlizing at least one injection well and at least one production well both completed in said hydrocarbon bearing strata and a finely divided hydrocarbon cracking catalyst delivered to said strata by an injection gas controlled at suitable pressure, temperature and $O_2$ content to promote and advance in place catalytic cracking of hydrocarbons and catalyst regeneration within said strata to be produced.

34 Claims, 7 Drawing Figures

HYDROCARBON RECOVERY FROM EARTH STRATA

Figure 1:
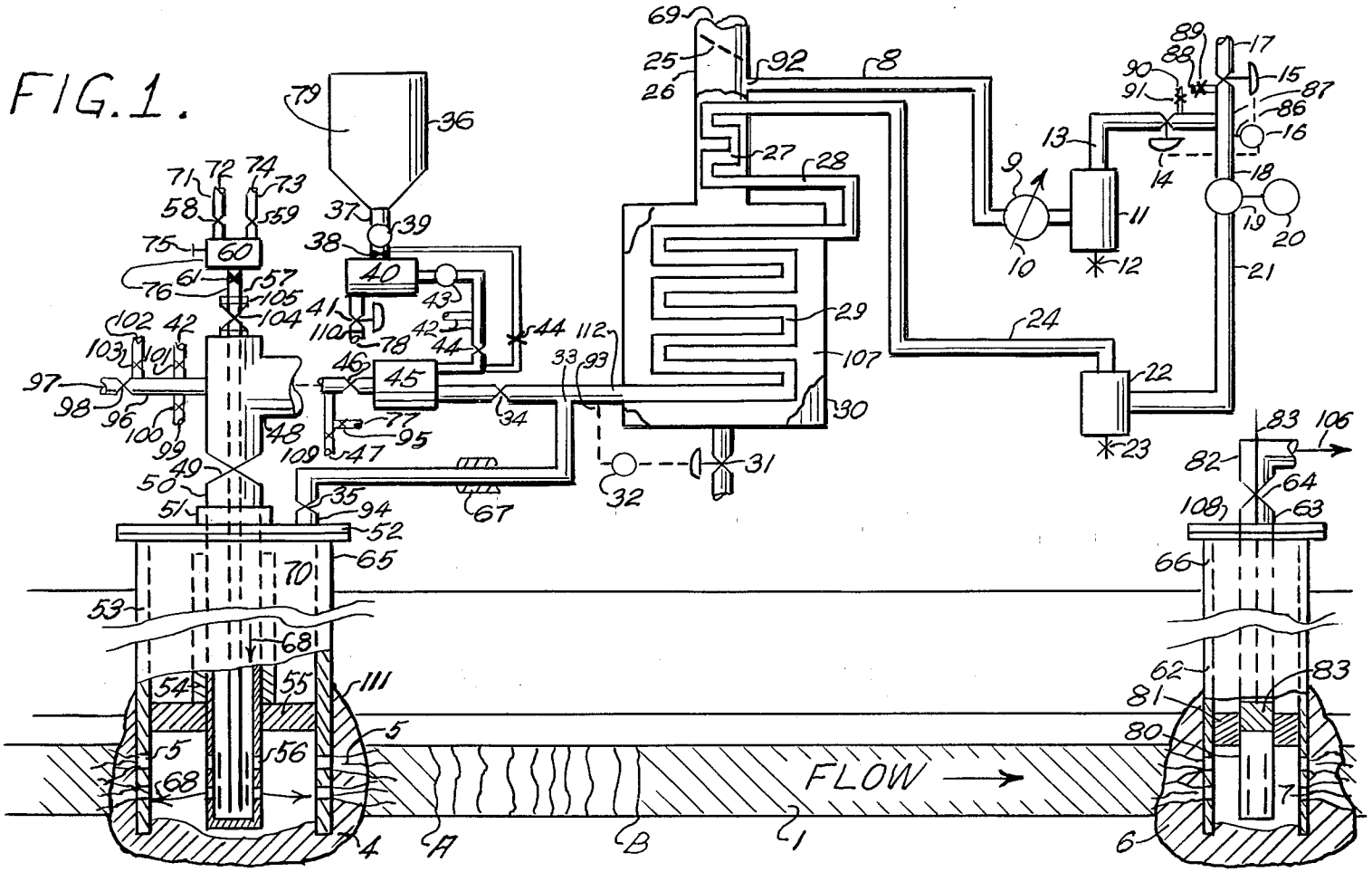

The U.S. has produced approximately 33% of the known oil originally in place. In this time of declining crude oil production approximately 300 billon bbls of known reserves await production providing methods that are technically and economically feasible can be developed. Why is oil recovery efficiency so low? Numerous works appearing in the literature attempt to answer this question and many solutions have been proposed over the years. A partial list of the reasons for low recovery efficiency are:

Dissipation of the lighter hydrocarbon components originally present in the reservoir fluid and produced with the crude in a solution drive production mechanism.

Depletion of gas pressure by not recycling produced gas during production.

Surface tension of the oil which causes it to preferentially cling to the surface of the individual grains comprising the reservoir strata or the surface of the pores or crevices found in the rock strata. These surface areas amount to 5 – 25Mft$^2$/ft$^3$ rock.

The higher viscosity of the oil with respect to driving media (gas or water) allows the driving media to slide by the oil leaving the largest part of the oil in place.

Accordingly the process of this invention attacks the above mentioned basic reasons for low recovery by catalytically cracking a portion of the heavier hydrocarbon molecules into lighter molecules. By producing small hydrocarbon molecules in place within the strata the process moves in the direction of reestablishing original reservoir conditions. In the case of hydrocarbon systems which are initially too viscous to be productive at the time of initial development, the catalytic process will also be effective. The process of this invention will convert heavy hydrocarbons into more mobile light molecules which are less viscous, act to dilute the uncracked heavy hydrocarbon molecules, provide additional gas sweep and heat transfer media until condensing in unreacted reservoir fluids, form solution phase drive fronts, and form a soluble oil drive flood phase. Surface generated heat and the heat liberated in the in place regeneration of the catalyst supply the endothermic heat required in the cracking process as well as that heat needed to establish the cracking temperature. Heat is also utilized in reducing the viscosity and surface tension of the unreacted hydrocarbons. The $CO_2$ produced in the catalyst regeneration (burning coke deposits off the surface of the catalyst) also aids in driving hydrocarbons to the producing well by forming a solution phase front when dissolved in the unreacted reservoir fluid. By providing for in place catalyst regeneration the process advantageously causes the individual catalyst particles to be available as reaction sites repeatedly and tends to heat balance the reservoir system. Accordingly the objects of the process of this invention are:

Provide a catalytic cracking process to be conducted within a strata to increase ultimate hydrocarbon recovery from the porous and permeable hydrocarbon bearing strata.

Provide a process whereby the catalyst may be regenerated in place within the strata in order to perform the catalytic cracking repeatedly.

Provide a process in which the exothermic heat of catalyst regeneration is balanced against the endothermic heat requirements of catalytic hydrocarbon cracking directly within the strata; heat in excess of that required for the catalytic cracking is utilized directly in preheating hydrocarbons prior to cracking, heating uncracked hydrocarbons thereby making them more flowable by reducing their viscosity and surface tension, and vaporizing cracked hydrocarbons thereby improving their flowability or permeability.

Provide a process in which the catalyst regeneration products of CO, $CO_2$ and $H_2O$ stimulate hydrocarbon production by reducing hydrocarbon viscosity and surface tension, adding to the volume of the process' inherent gas drive and aiding heat transfer. In the case of $CO_2$ which when dissolved in hydrocarbons forms a solution phase which improves the gas drive efficiency.

Provide a process in which catalytically cracked hydrocarbon products are themselves more flowable and when the cracked hydrocarbons dissolve into uncracked hydrocarbons downstream within the strata reduce the viscosity and surface tension of the uncracked hydrocarbons making them more flowable.

Provide a process in which heated, pressurized injection gas used as a catalyst transport media or as a catalyst regeneration agent inherently provides a gas drive mechanism for pushing hydrocarbons thru the strata to the production well.

Provide a means of transporting catalyst to a hydrocarbon zone within a porous and permeable hydrocarbon bearing strata under suitable conditions of pressure and temperature to achieve catalytic cracking of hydrocarbons.

Provide a means of advancing the catalytic hydrocarbon cracking zone from the injection well to the production well by transporting regenerated catalyst from the regeneration zone to the hydrocarbon cracking zone.

Provide means of sizing hydrocarbon cracking catalyst particles so that said catalyst may be effectively delivered to and transported thru the hydrocarbon-bearing porous and permeable strata.

Provide a means of delivering to the porous and permeable hydrocarbon-bearing strata an initial catalyst charge in slurry form if conditions dictate.

Provide means of reducing the possibility of Na ion contamination of the aluminosilicate zeolite component of the catalyst by a preliminary treating step.

Provide a means of controlling the $O_2$ content of the injection gas if reservoir and hydrocarbon system response dictate the necessity of a varied $O_2$ content injection gas mode of operation.

Provide a catalytic process of cracking hydrocarbons deposited in hydrocarbon-bearing porous and permeable strata to stimulate the recovery of said hydrocarbons if the response of the reservoir/hydrocarbon system shows that a varied $O_2$ content operation would be more effective than a constant $O_2$ content operating mode.

Provide a means of controlling the injection temperatures of the catalyst and $O_2$ content of the injection gas as deemed suitable by the response of the particular reservoir/hydrocarbon system.

Provide a means of controlling the $O_2$ content of the of the injection gas to control the regenerating temperature and coke make depending upon the response of a particular reservoir/hydrocarbon system to the process of this invention.

Provide a stripping step in the operation of the process order to maximize $O_2$ utilization and maximize hydrocarbon recovery.

Provide means of initiating the process of this invention.

Provide means of reverse flowing the strata produced in the process of this invention when the reservoir-hydrocarbon system response to the process dictates.

FIG. 1: A vertical elevation, partly in section, shows the overall arrangement and constuction of various parts and elements used in the process of this invention "Hydrocarbon Recovery from Earth Strata"

Figure 2:
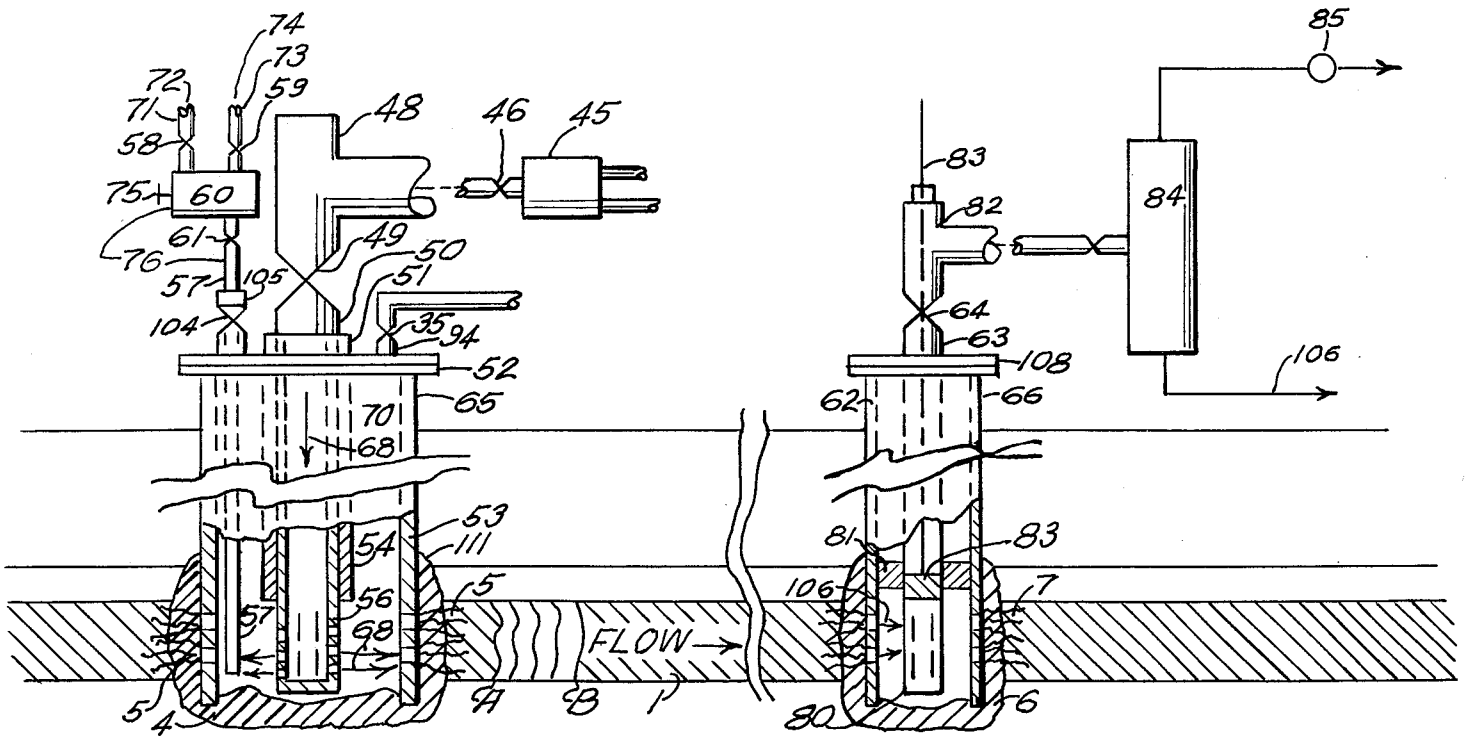

FIG. 2: A fragmental vertical elevation, partly in section, shows an alternate location of the ignitor system and more complete production well equipment, and supplements FIG. 1 in showing overall arrangement and construction of various parts and elements used in the process of this invention "Hydrocarbon Recovery from Earth Strata"

Figure 3:
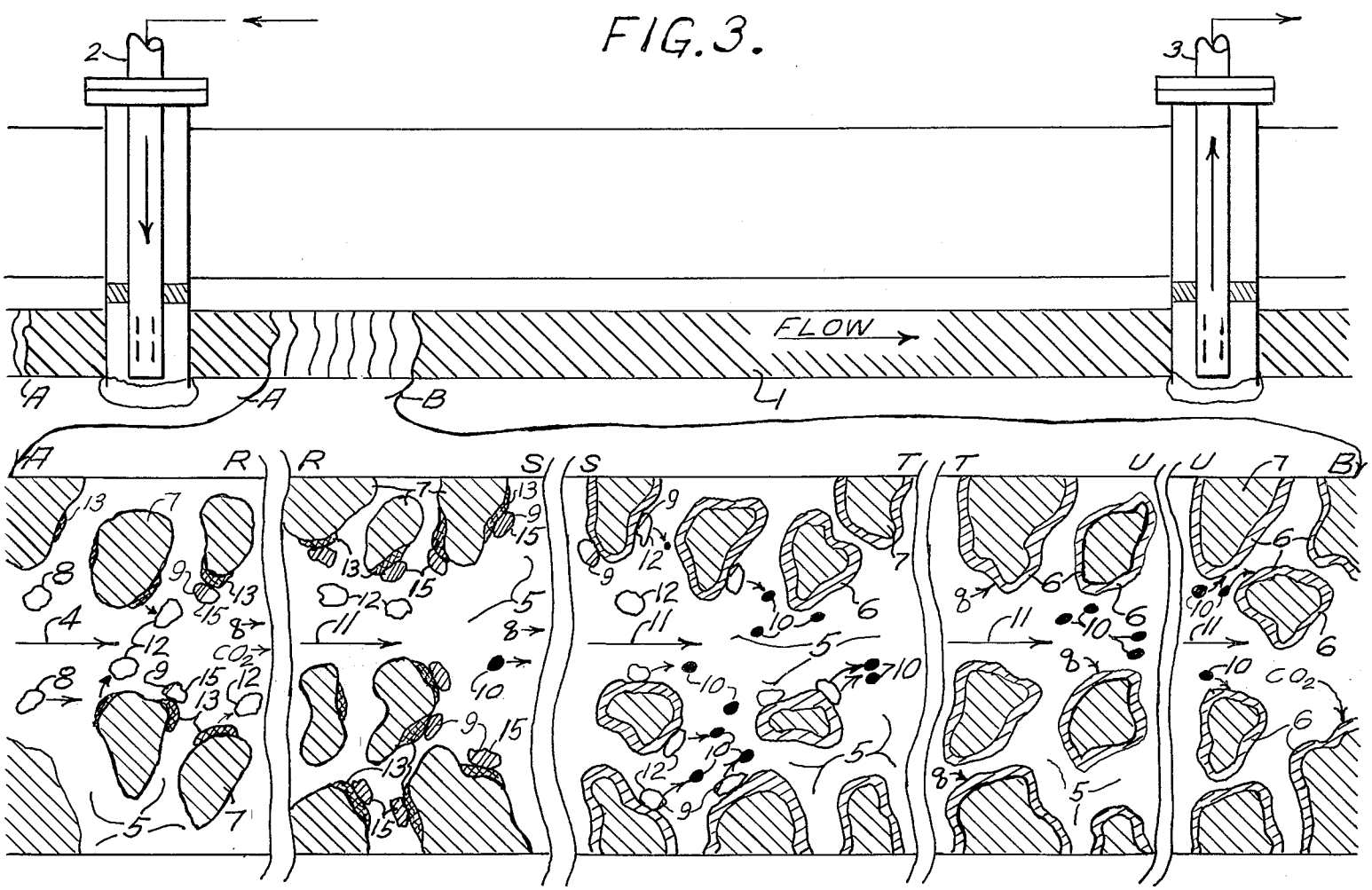

FIG. 3: A process schematic of a partly sectional vertical elevation of the process of this invention "Hydrocarbon Recovery from Earth Strata", shows with blown up section AB, the active zone of the hydrocarbon strata, the chemical and physical processing operations occurring when active cracking catalyst in continuously delivered to the hydrocarbon strata by a heated $O_2$ containing injection gas.

Figure 4:
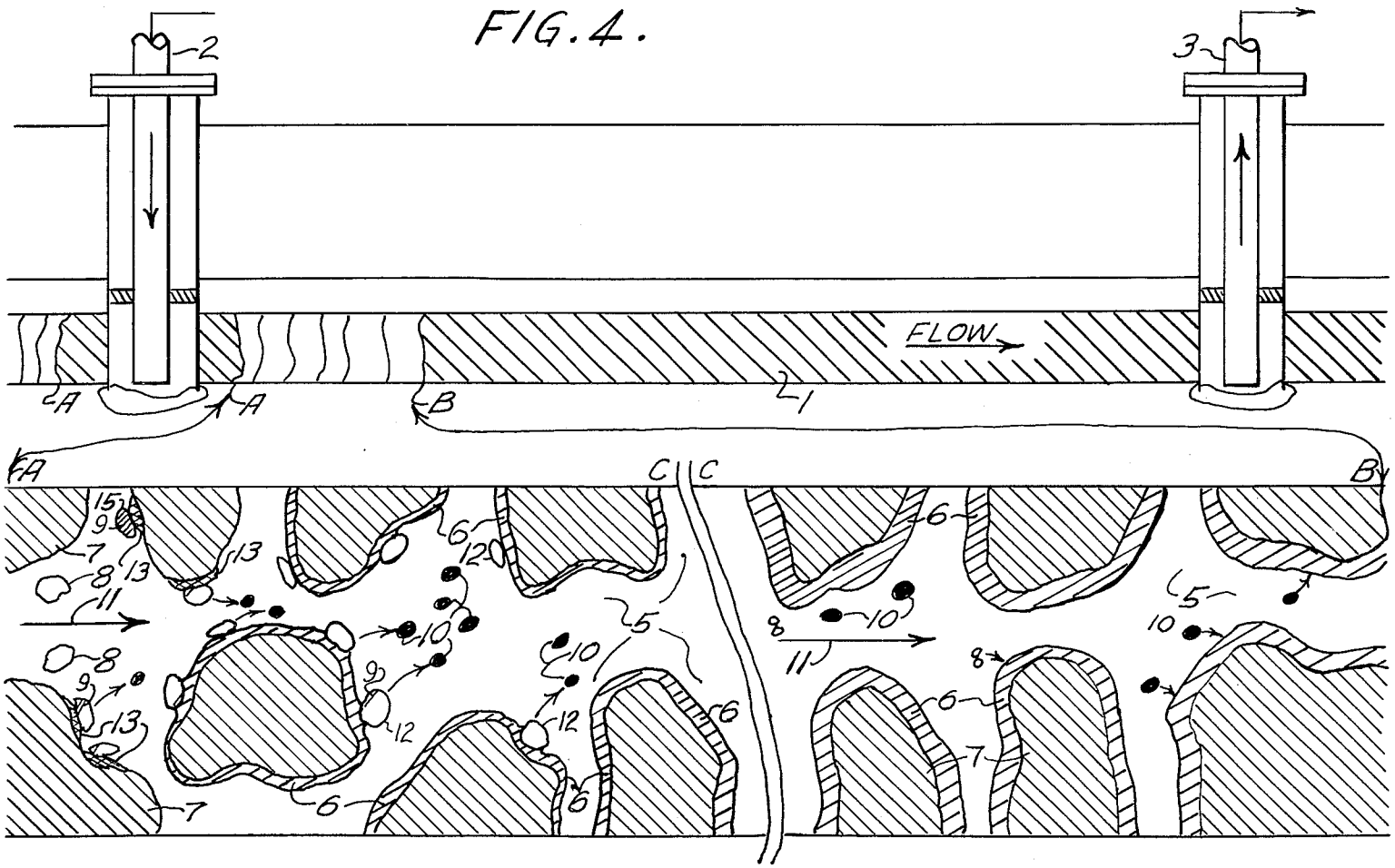

FIG. 4: A process schematic of a partly sectional vertical elevation of the process of this invention "Hydrocarbon Recovery from Earth Strata", shows with blown up section AB, the active zone of the hydrocarbon strata, the chemical and physical processing operations occurring when active cracking catalyst is continuously delivered to the hydrocarbon strata by a heated inert injection gas for purposes of catalytically cracking hydrocarbons within said strata.

Figure 5:
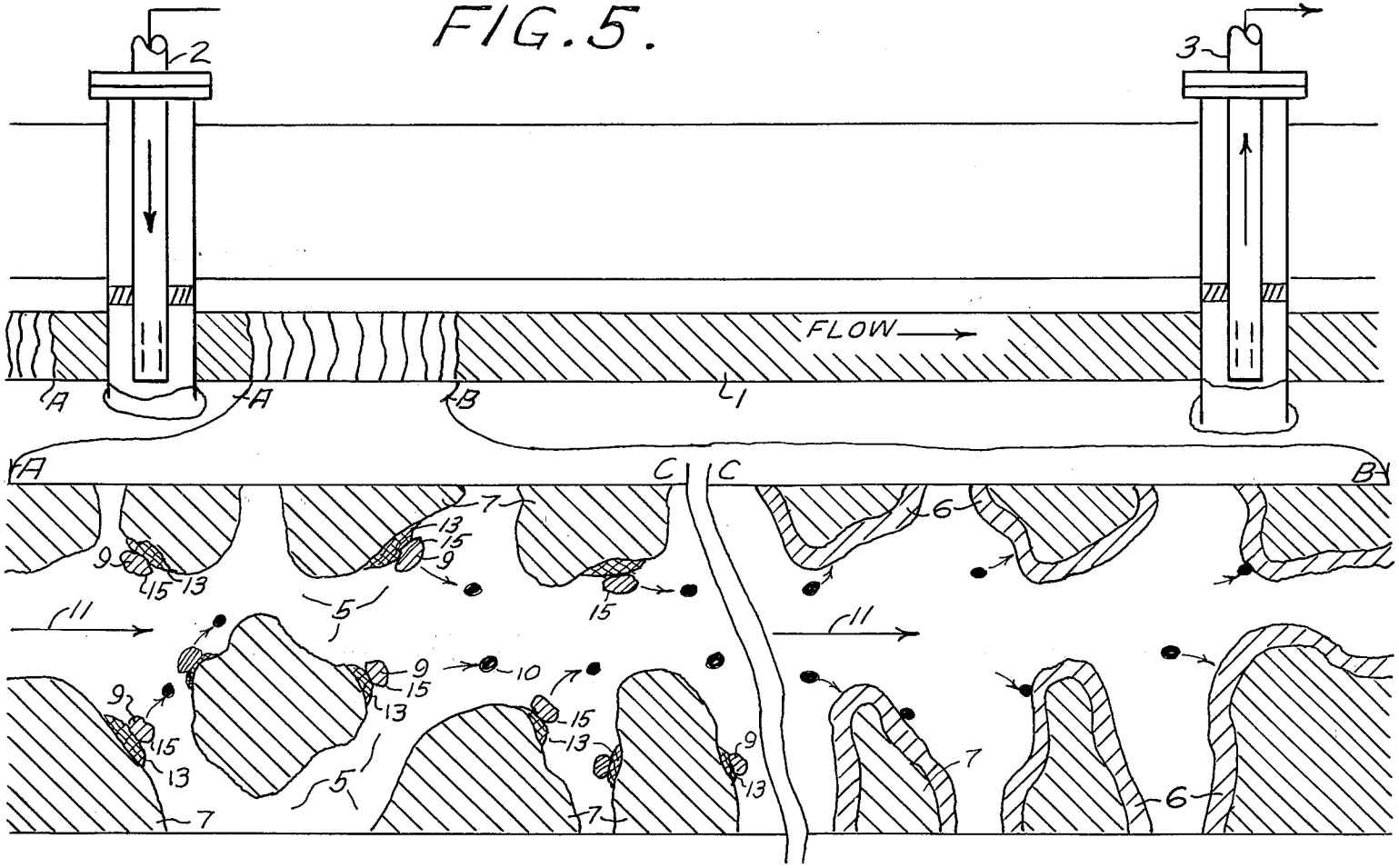

FIG. 5: A process schematic of a partly sectional vertical elevation of the process of this invention "Hydrocarbon Recovery from Earth Strata" shows with blown up section AB, the active zone of the hydrocarbon strata, the chemical and physical processing operations occurring when heated inert injection gas is continuously delivered to said hydrocarbon strata for purposes of stripping volatile hydrocarbons off deactivated catalyst.

Figure 6:
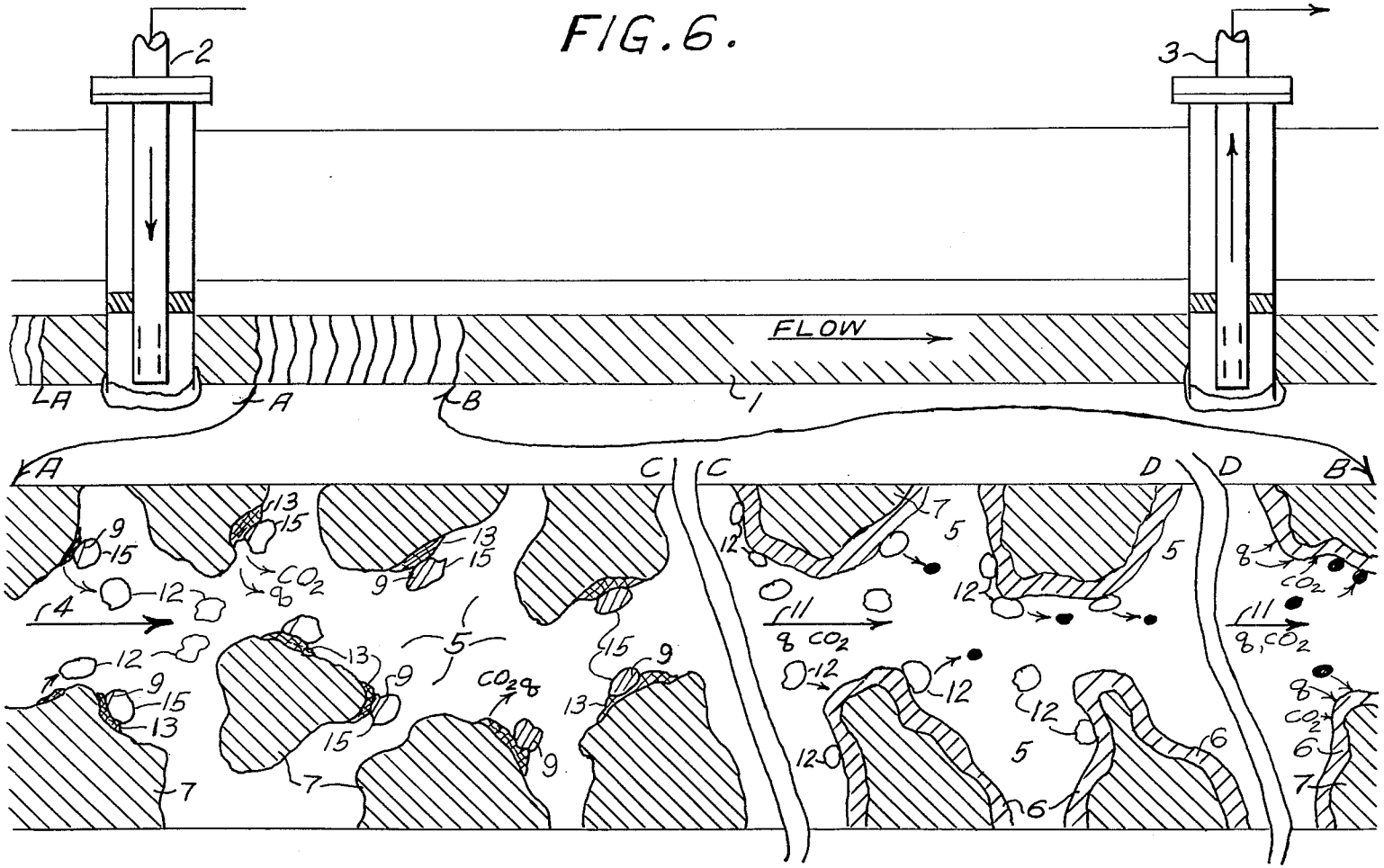

FIG. 6: A process schematic of a partly sectional vertical elevation of the process of this invention "Hydrocarbon Recovery from Earth Strata" shows with blown up section AB, the active zone of the hydrocarbon strata, the chemical and physical processing operations occurring when heated $O_2$ containing injection gas is continuously delivered to said hydrocarbon strata for purposes of regenerating previously deactivated hydrocarbon cracking catalyst within said strata.

Figure 7:
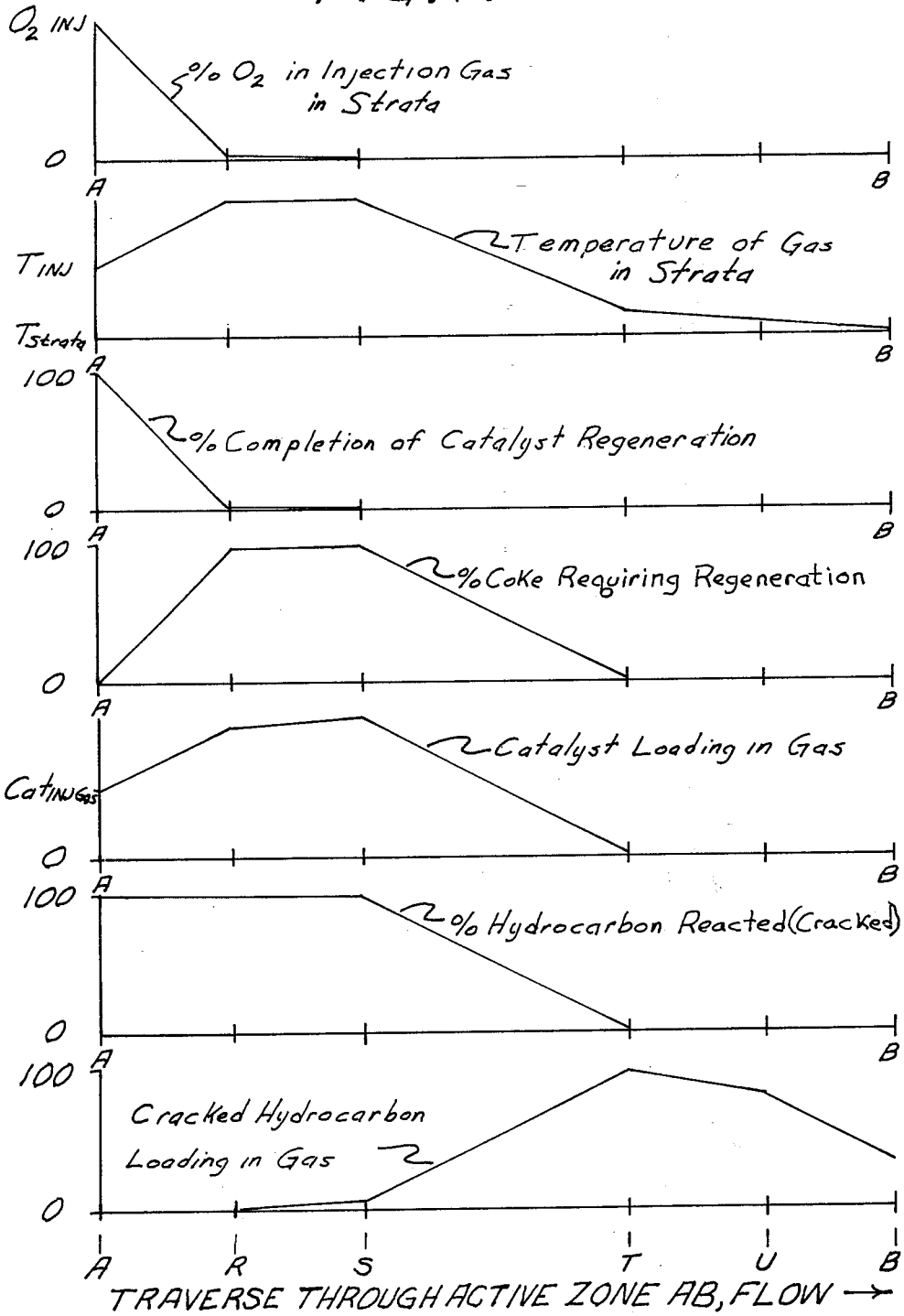

FIG. 7: is a series of graphs showing operating variables plotted against traverse through active zone AB of the hydrocarbon bearing strata when active catalyst in continuously delivered by a heated $O_2$ containing injection gas. These graphs also illustrate the chemical and physical processing operations occurring within said strata active zone AB.

The invention will be better understood from a more detailed description thereof, reference being had to the accompanying drawings wherein like numeraled and lettered parts and elements, therein denote like numeraled and lettered parts and elements herein.

Referring to FIG. 1, injection well 65 and production well 66 are shown completed in hydrocarbon bearing porous and permeable strata 1 which is to be produced by the catalytic hydrocarbon cracking process of this invention. Finely divided hydrocarbon cracking catalyst particles 79, of the variety commonly used in the petroleum refining industry, are stored in catalyst storage bin 36. Catalyst flows through the bin outlet line 37 to pressurized dry bulk feeder 39 which feeds the catalyst to either the mix drum 45 or to the catalyst slurrying mixer 40. Compressor 19 delivers hot injection gases 68 to the mix drum via furnace outlet header block valve 34 through the mix drum, mix drum outlet valve 46 to the injection well tubing manifold 48. The injection gases indicated by arrows 68 flow downwardly through injection tubing block valve 49, injection well tubing 50, tubing slotted section 56, through casing 53 and casing bore hole cement 4 perforations 5 into hydrocarbon bearing strata 1. The injection well 65 having full depth casing 53 is hermetically sealed at the upper surface end by wellhead 52 which is fitted with tubing expansion gland 51. Said injection well tubing 50 extends downwardly through said expansion gland and bottoms such that the slotted tubing section 56 oppositely opposes said hydrocarbon strata 1. Said injection well tubing 59 is equipped with adjustable casingtubing packer 55, adjacent the slotted tubing section that hermetically seals the tubing casing annulus 70. Insulation 54 covers the outer wall of said tubing 50 from the said packer 55 up to said wellhead in order to minimize heat loss. Insulation 67 also covers hot lines and equipment located on the surface as safe and economical operations dictate. Production well 66 shown completed in strata 1 consists of casing 62, casing-bore hole cement 6, tubing 63, extending through wellhead 108 and equipped with tubingcasing packer 81 adjacent the production tubing slotted section 80. Said production tubing slotted section 80 oppositely opposes the perforations 7 extending through the casing 62 and cement 6 and into said hydrocarbon strata. Said production well is equipped with a pumping unit 83, shown in FIG. 2, that extends downwardly through the tubing, bottoming adjacent the slotted section thereof. Referring to FIG. 2, the pumping unit discharges upwardly through said tubing 63, tubing block valve 64, production tubing manifold 82, and into the production separator 84. Production separator off gas vacuum pump 85 pulls suction on the gas outlet of the said production separator 84, thereby controlling the back pressure maintained on said strata 1. Referring to FIG. 1, injection compresssor 19, driven by motor 20 delivers pressurized injection gas 68 to fired furnace 30 convection section coils 27 via compressor discharge header 21, compressor discharge knockout drum 22 and discharge knockout outlet transfer pipe 24. Furnace transfer pipe 28 delivers gas to the furnace radiant section coils 29. Furnace outlet temperature element 93 located in furnace outlet manifold 33, signals furnace outlet temperature controller 32 which adjusts furnace control valve 31, thereby maintaining suitable injection gas temperature. The furnace outlet manifold is connected to the injection well annulus 70 by wellhead connection 94 and annulus flow block valve 35. Said furnace outlet manifold 33 is also connected to the mix drum 45 via furnace outlet header block valve 34. A fuel gas supply pipe 47 and block valve 109 is in communication with said injection tubing manifold 48 downstream of the mix drum outlet valve 46. Also in communication with said injection tubing manifold 48 is the inert purge gas supply pipe 77 and valve 95. A strata pretreating manifold 96 is in communication with said injection tubing manifold 48. Located on said pretreating manifold 96 and in communication with the injection tubing manifold 48 are the following: a steam supply pipe 97 and steam block valve 98, a deionized water supply pipe 99 and deionized water block valve 100, a catalyst slurry supply pipe 42 and block valve 101, and an atmospheric vent 102 and block 103. Injection gas compressor 19 is equipped with suction header 18 in which is located gas analysis sensing element 86. Upstream of the compressor suction header 18 is compressor suction manifold 87, having the following in communication: an air intake control valve 15, an $O_2$ supply pipe 88 and $O_2$ block valve 89, an inert gas control valve 14 and a non-flue inert gas supply pipe 90, inert gas block valve 91. The air intake control valve 15 is in communication with an atmospheric air suction 17. The inert gas control valve is in communication with fired furnace 30 stack opening 92 via inert gas supply pipe 8, inert gas cooler 9, inert gas liquid knockout drum 11, and inert gas knockout outlet pipe 13. The cooling media 10 used in inert gas cooler 9 is either water or air which ever is available in the field. The knockout drums 11 and 22 are equipped with liquid drains 12 and 23 respectively. The ignitor system 76 used in the initiation of the process of this invention consists of an ignitor tubing 57 that extends downwardly through tubing manifold 48, injection well tubing 50 and bottoms oppositely opposed tubing slotted section 56. A retrieval block valve 104 and packing gland 105 are located at the top of said injection tubing manifold 48 which makes retreival of the ignitor tubing 57 possible. At the upper end of said ignitor tubing 57 is a block valve 61 which allows ignitor tubing shut off. Above the block valve 61 is the ignitor chamber 60 in communication with fuel gas supply 71 and block valve 58 and air supply pipe 73 and block valve 59. The igniter chamber 60 is equipped with high voltage ignitor 75 by means of which the fuel gas 71 is ignited in said ignitor chamber 60 causing a flame to travel down said ignitor tube 57 to ignite fuel gas flowing from slotted tubing section 56 into strata 1 to bring about in place combustion of the hydrocarbons contained in strata 1. Catalyst 79 stored in said catalyst storage bin 36 is also delivered by said pressurized dry bulk feeder 39 to catalyst slurrying mixer 40. Slurrying fluid 78 controlled by flow control valve 41 flows into said slurrying mixer 40 which supplies a homogenous catalyst slurry to catalyst slurry pump 43 which discharges into slurry supply pipe 42. Said slurry supply pipe 42 is connected via block valve 101 to pretreating manifold 96 in communication with said injection well tubing 50 and is connected to said mix drum 45 via slurry pump block valve 44. Shown in fragmentary partly sectional elevation, FIG. 2 is an alternate ignitor system 76 which extends through the annulus 70 in injection well 65 which is completed without the adjustable packer. The numbering system used in FIG. 1 is also used in FIG. 2. Referring to FIG. 2 ignitor system 76 tubing 57 extends downwardly through injection well 65 annulus 70 bottoming oppositely opposed injection tubing slotted section 56.

Shown in FIG. 1 and FIG. 3 the process of this invention is in "steady state" operation. Active zone AB of hydrocarbon bearing porous and permeable earth strata 1 is experiencing catalytic hydrocarbon cracking and other related chemical processing operations, which are to be discussed below, brought about by continuously introducing under pressure via the injection well 65 a heated $O_2$ containing gas 68 and hydrocarbon cracking catalyst 79. Referring to FIG. 1, showing injection well 65 and production well 66 completed in porous and permeable hydrocarbon bearing strata 1, compressor 19 is delivering pressurized $o_2$ containing gas via compressor discharge knockout drum 22 to furnace convection section coils 27 and radiant section coils 29 in which heating of injection gas is accomplished. The temperature control of the heated, pressurized $O_2$ containing injection gas is sensed by furnace outlet temperature sensing element 93 located in furnace outlet manifold 33 which has insulation 67 as dictated by safe and efficient operations. Hot $O_2$ containing injection gas flows through furnace outlet header block valve 34 and into mix drum 45 where fresh hydrocarbon cracking catalyst 79 and said gas are mixed and flow through mix drum outlet block valve 46 to injection well tubing manifold 48. Flowing from the tubing manifold 48 the catalyst-carrying, hot, $O_2$ containing injection gases 68 flow downwardly through injection well tubing block valve 49, tubing 50 and tubing slotted section 56 oppositely opposed casing 53 and cement 4 perforations 5 into hydrocarbon bearing strata 1. The established direction of flow through the strata 1 is from injection well 65 to production well 66. The $O_2$ content of the $o_2$ containing gas is controlled by the gas analysis controller 16 that has a gas analysis sensing element 86 located in compressor 19 suction header 18. Control of the $O_2$ content is achieved by the controller 16 opening air intake control valve 15 on atmospheric air suction 17 and inert gas control valve 14 on inert gas supply pipe 8 as required. Both the air intake control 15 and the inert gas control 14 valves are connected to compressor suction manifold 87. Hydrocarbon cracking catalyst 79 stored in catalyst storage bin 36 is fed by a pressurized dry bulk feeder 39 to mix drum 45 where it is intimately mixed with the injection gas which then flows via said injection well tubing 50 into and through the hydrocarbon bearing strata 1 to said zone AB.

FIG. 3 is a schematic of the vertical elevation of the steady state operation of the process of this invention in which heated $O_2$ containing gas and catalyst are being continuously introduced into said strata 1 under pressure via injection well 65. Active zone AB of strata 1 is shown blown up to microscopically illustrate the chemical and physical phenomena taking place in the functional zones of catalyst regeneration AR, catalyst stripping RS, catalytic hydrocarbon cracking ST, hydrocarbon preheating TU, and solution UB. In FIG. 3, injection well 2 and production well 3 are shown completed in said hydrocarbon bearing strata 1. Flow is from well 2 to well 3 in the strata. Oxygen rich hot injection gas 4 is being delivered to strata 1 in place regeneration zone AR, the most upstream of the functional zones which has previously been subjected to the following processing operations: solution, preheating, catalytic cracking and stripping in that chronological order. Shown in FIG. 3 zone AR are sand grains 7, fresh catalyst 8 carried to strata 1 by $O_2$ rich injection gas 4, regenerated catalyst particles 12 freed to enter gas stream 4 flowing through strata pores 5, cracking residue 13 which binds deactivated catalyst 15 to sand or pore surfaces. Catalyst deactivation is caused by deposition of coke 9 on the catalyst surface. The catalyst regeneration zone is characterized by:

A. Deactivated catalyst particles 15 being burned clean of coke 9, released from the pore surfaces by the burning of cracking residue 13 binding them to the pore surfaces, and the regenerated catalyst particles 12 entering the hot regenerating gas 4 stream flowing downstream through said zone AR;

B. A hot fresh catalyst 8 carrying $O_2$ containing regenerating gas 4 which on entering said zone AR has maximum oxygen content and on exiting said zone AR is depleted of $O_2$ and is an inert gas 11;

C. A heat release brought about by the exothermic regeneration reaction;

D. A temperature rise in said zone AR caused by the release of regeneration heat;

E. Formation of regeneration products of CO, $CO_2$ and water vapor entering the inert gas stream 11 moving downstream through said strata 1 toward said production well 3.

Hot gases 11 exiting the catalyst regeneration zone AR, depleted of $O_2$ enter the stripping zone RS the second most upstream of the functional zones comprising active zone AB of strata 1 in FIG. 3. Said stripping zone RS has previously experienced the chemical processing operations of solution, preheating and catalytic cracking in the listed chronological order. The hot gas flow 11 containing regeneration products of CO, $CO_2$ and water vapor and transporting surface injected fresh catalyst 8 and regenerated catalyst 12 vaporize and drive volatile hydrocarbons from said stripping zone which is characterized by:

A. Deactivated catalyst particles 15 covered with coke deposits 9 and bound by cracking residue 13 to pore 5 surfaces (sand grain 7 surfaces);

B. A hot inert stripping gas 11, depleted of $O_2$ and containing regeneration reaction products maximizing the utilization of the compressor 19 (FIG. 1) capacity by removing $o_2$ consuming volatile hydrocarbons from the coke, catalyst and cracking residue and maximizing hydrocarbon recovery.

Hot gases 11 transporting fresh 8 and regenerated catalyst 12 exiting said stripping zone RS, enter the catalytic cracking zone ST, the third most upstream of the functional zones comprising active zone AB. The catalytic cracking zone has previously been subjected to the chemical processing operations of solution and preheating, chronologically, and is characterized by:

A. Regenerated 12 and fresh 8 catalyst, carried by $O_2$ deficient hot gases 11, being deposited on large uncracked hydrocarbon molecules 6 found clinging to and coating pore 5 surfaces of the strata 1 and contacting intermediate weight hydrocarbon molecules which may be vaporizing into the gas stream;

B. Large hydrocarbon molecules adsorbed on the catalyst surfaces being cracked into smaller more mobile molecules 10 which desorb the catalyst surface and vaporize into the gas stream flowing downstream through the hydrocarbon bearing strata toward the production well;

C. The deposition of coke 9 on the surface of the catalyst brings about catalyst deactivation;

D. The formation of cracking residue 13 which binds the catalyst particles to the pore surfaces once hydrocarbons present in the catalytic cracking zone have been effectively "cracked out"

E. Concentration gradients of cracking residue 13 which are at the highest concentration levels at the inlet of the cracking zone and are at progressively lower concentration levels at each succeeding point downstream within said catalytic cracking zone ST;

F. Concentration gradients of uncracked hydrocarbons 6 having the lowest concentration at the inlet of the catalytic cracking zone and the highest concentration at the outlet of the catalytic cracking zone;

G. The delivery of heat to the catalytic cracking zone by the hot gases 11 flowing from said regeneration AR and stripping RS zones thereby maintaining the required cracking temperature and supplying the necessary endothermic heat of catalytic cracking. These concentration gradients are graphically presented in FIG. 7. Hot inert gases 11 leaving the catalytic cracking zone containing vaporized hydrocarbon cracking products 10 and regeneration products CO, $CO_2$ and water vapor enter the preheating zone TU containing uncracked hydrocarbons 6. Said preheating zone, the fourth most upstream of the functional zones, comprising hydrocarbon bearing strata 1 active zone AB having been previously subjected to the chemical process operation of solution.

Preheating zone TU is characterized by:

A. Uncracked hydrocarbons 6 clinging to the surface of the pores 5 and crevices found in the porous and permeable hydrocarbon bearing earth strata 1;

B. A flow of hot gas 11 containing catalyst regeneration products of CO, $CO_2$ and water vapor, a range of hydrocarbon catalytic cracking products 10, and nitrogen contained in the injection gas introduced at the surface;

C. Heat q transferred to the uncracked hydrocarbons 6 from the hot gases flowing through the preheating zone thereby raising the temperature of said uncracked hydrocarbons 6 to that required for the catalytic cracking reaction;

D. Improving the mobility of the uncracked hydrocarbon 6 by raising their temperature thereby lowering the surface tension and viscosity of said uncracked hydrocarbons. Cooled inert gases 11 leaving the preheating zone TU and entering the solution zone UB the most downstream of the functional zones of the active zone AB of strata 1. Functional zone UB, the solution zone is being subjected to the initial processing operation of the process of this invention. Said solution zone is characterized by A. Uncracked hydrocarbons 6 clinging to the surfaces of pores 5 and crevices found in the porous and permeable hydrocarbon bearing earth strata 1;

B. Flowing inert gas 11 originally containing catalyst regeneration products of CO, $CO_z$ and water vapor, a range of hydrocarbon catalytic cracking products 10, and nitrogen introduced into strata 1 via the injection gas originating at the surface, a portion of cracked hydrocarbons 10 having been cooled in said preheat zone TU to their dew point are condensing in said zone UB;

C. The condensing cracked hydrocarbon 10 components are going into solution in the uncracked hydrocarbons 6 found in said zone UB of the strata 1;

D. The $CO_2$ is dissolved into the uncracked hydrocarbons found in said zone UB of the strata 1 forming a solution phase which is more effectively driven through said strata 1 toward the production well 3 by the gas drive mechanism inherent in the injection gas utilized in the process of this invention;

E. The forming of solution phases of cracked hydrocarbons 10 and $CO_2$ absorbed into the uncracked hydrocarbons 6 improves the mobility of uncracked hydrocarbons 6 by reducing surface tension and viscosity of said uncracked hydrocarbons 6. Continued operation of the process of this invention by introducing heated $O_2$ containing gas and said hydrocarbon cracking catalyst advances said active zone AB through said strata 1 from injection well 2 to production well 3 thereby bringing about increased recovery of said hydrocarbons from said strata 1.

Due to the varied geological and physical properties of the hydrocarbon bearing porous and permeable earth strata and to the numerous variations in the chemical and physical properties of the hydrocarbons, the response of one particular reservoir/hydrocarbon system to the process of this invention that of catalytically stimulating hydrocarbon recovery from earth strata will differ from the response of another system. For this reason the mode of operation, independent process variables or techniques may be varied accordingly.

A second mode of operation of the process of this invention, is discussed in detail below. Reference will be made to FIG. 1, the overall process vertical elevation that is partly sectional. Also referred to in the discussion of this mode will be FIGS. 4, 5, 6, which are schematic vertical elevations also partly sectional with enlarged views of the hydrocarbon strata illustrating microscopic details of rock grains, rock pores, catalyst and hydrocarbons. FIGS. 4, 5, and 6 illustrate the steps of catalytic hydrocarbon cracking, catalyst stripping and catalyst regeneration, respectively. In the second mode of operation of catalytically producing hydrocarbons from earth strata in the process of this invention shown in FIG. 1 and in FIGS. 4, 5 and 6, active zone AB of strata 1 is an established operating zone undergoing chemical processing steps of catalytic cracking of hydrocarbons, stripping of volatile hydrocarbons from deactivated catalyst and catalyst regeneration performed in a repetitive manner. Referring to FIG. 1, showing injection well 65 and production well 66 completed in porous and permeable hydrocarbon bearing strata 1, compressor 19 is delivering pressurized inert gas obtained by the action of gas analysis controller 16 which automatically opens inert gas control valve 14 and closes air intake control valve 15. The pressurized inert gas flows via compressor discharge knockout drum 22 to furnace convection secton coil 27 and radiant section coils 29 in which heating of injection gas 68 is accomplished. The temperature of said heated, pressurized inert injection gas sensed by furnace outlet temperature sensing element 93 located in furnace outlet manifold 33 and is controlled by furnace outlet temperature controller 32 which operates furnace control valve 31. Insulation 67 covers all hot gas transfer lines and equipment as dictated by safe and efficient operations. Said hot inert injection gas flows via furnace outlet header block valve 34 into mix drum 45 where fresh hydrocarbon cracking catalyst 79 and injection gas are mixed and flow through mix drum outlet block valve 46 to injection well tubing manifold 48. Flowing from the tubing manifold 48, the catalyst-carrying, hot, inert injection gases 68 flow downwardly through injection well tubing block valve 49, tubing 50 having insulation 54, tubing slotted section 56 and casing 53 and cement 4 perforations 5 into said oppositely opposed hydrocarbon bearing strata 1. The established direction of flow through said strata 1 is from said injection well 65 to said production well 66.

Hydrocarbon cracking catalyst 79 stored in catalyst storage bin 36 is fed by pressurized dry bulk feeder 39 to mix drum 45 where it is intimately mixed with said hot injection gas 68 which admixture then flows via said injection well tubing 50 into and through said hydrocarbon bearing strata 1 to said zone AB.

FIG. 4 is a schematic of the vertical elevation of the mode of operation in which catalytic cracking of hydrocarbons is established in said active zone AB of said earth strata 1. Active zone AB is shown blownup to microscopically illustrate the chemical and physical phenomena taking place within the strata during the catalytic cracking step of the process. Referring to FIG. 4, injection well 2 and production well 3 are shown completed in hydrocarbon bearing strata 1 with inert injection gas 11 flow direction established from injection well to production well. Said hot injection gas 11 is shown transporting and delivering fresh catalyst 8 to hydrocarbon catalytic cracking zone AC. Shown in FIG. 4 of said zone AC are sand grains 7, uncracked hydrocarbons 6 coating sand grains and clinging to surfaces of the strata pores 5, coke 9 being deposited on catalyst surfaces, deactivated catalyst 15 bound to pore surfaces by cracking residue 13, cracked hydrocarbon products 10 desorbing the catalyst surfaces and entering the gas stream flowing downstream through said strata 1 to the production well. Said cracking zone AC of the hydrocarbon catalytic cracking cycle step of the process is characterized by hot active catalyst 8, contacting and adsorbing previously heated large molecular weight hydrocarbons 6 found either clinging to the pore 5 surfaces within the strata or vaporizing into the gas stream, cracks said large molecules 6 into smaller more mobile hydrocarbon molecules 10, which desorb the catalyst and enter the flowing inert gas stream 11, and cracking reaction coproducts of coke deposits 9 on catalyst and cracking residue 13 which binds the spent catalyst to said strata pore surface within said catalytic hydrocarbon cracking zone AC; thereby producing a supply of smaller hydrocarbon molecules 10 which flow downstream thru the hydrocarbon bearing strata toward the production well.

Solution zone CB of FIG. 4 showing inert gas 11, uncracked hydrocarbons 6, cracked hydrocarbon products 10, and heat q. Said solution zone CB located within strata 1 downstream of catalytic cracking zone AC is characterized by a flow of hot inert gas 11 and cracked hydrocarbons 10 which deliver heat q to said uncracked hydrocarbons 6 and raises the temperature of said uncracked hydrocarbons 6 reducing their viscosity and surface tension making said hydrocarbons 6 more flowable, simultaneously said light hydrocarbon cracking products 10 being cooled to their dew point in their traverse through said strata 1 condense and dissolve into said uncracked heavy hydrocarbons 6 also bringing about a reduction in viscosity and surface tension thereby making them more susceptible to being driven toward the production well by the inert gas sweep mechanism inherent in the process.

FIG. 5 is a schematic of the vertical elevation partly sectional of stripping step utilized in the second mode of operation of catalytically producing hydrocarbons from earth strata in the process of this invention with active processing zone AB established. Active zone AB is shown blownup to microscopically illustrate the chemical and physical phenomena taking place within the strata during the catalyst stripping step of the process. Injection well 2 and production well 3 are shown completed in hydrocarbon bearing strata 1 with inert injection gas 11 flow established within said strata 1 from said injection well 2 to said production well 3. Hot injection gas is shown flowing into catalyst stripping zone AC. Shown in said zone AC are sand grains 7, strata pores 5, deactivated catalyst 15, coke 9, cracking residue 13, and cracked hydrocarbons 10. Said stripping zone AC of the catalyst stripping cycle step of the process is characterized by shutting down surface addition of said heated catalyst 79 to said hydrocarbon bearing porous and permeable strata 1 but continuing the flow of hot inert injection gas 11 to bring about the stripping of volatile hydrocarbons 10 from said coke 9, deactivated catalyst 15 and cracking residue 13 found in the previous catalytic hydrocarbon cracking zone thereby removing valuable hydrocarbons contained therein prior to initiating the subsequent regeneration step which burns any combustible materials present in this zone AC.

FIG. 6 is a schematic of the partly sectional vertical elevation of the catalyst regeneration step of this mode of operation of catalytically producing hydrocarbons from earth strata in the process of this invention with active processing zone AB established. Said active zone AB is shown blownup to microscopically illustrate the chemical and physical phenomena taking place within said strata 1 during the catalyst regeneration step of the process. Injection well 2 and production well 3 are shown completed in the hydrocarbon bearing strata 1 with $0_2$ containing injection gas 4 flow direction established within said strata 1 from said injection well 2 to said production well 3. Shown in said catalyst regeneration zone AC are sand grains 7, cracking residue 13, deactivated catalyst 15, coke 9, regenerated catalyst 12, heat *q*, combustion products CO, $CO_2$ and inert gas 11. Said catalyst regeneration zone AC of the catalyst regenerating step of the process is characterized by the delivery of hot $0_2$ containing injection gas 4 to said strata zone AC via said injection well 2, accomplished by raising the $0_2$ demand on the gas analysis controller 16 of FIG. 1 which opens air intake control valve 15 and closes inert gas control valve 14. Referring to FIG. 6 the hot $O_2$ containing injection gas 4 brings about the regeneration and liberation of deactivated catalyst found in previously cracked and stripped zone AC by burning said coke deposits 9 off catalyst 15 and the burning of said cracking residue 13 binding said catalyst 15 to the pore 5 surfaces. This combustion produces heat *q*, CO, $CO_2$ and water vapor and frees regenerated catalyst 12, which enter the $O_2$ depleted inert gas stream 11 exiting said regeneration zone AC. Heat *q* produced in the exothermic regeneration reaction is balanced against and provides the endothermic catalytic cracking heat requirements. Zone CD of FIG. 6 located downstream of said regeneration zone AC within said strata 1 is shown receiving said inert gas 11 transporting heat *q*, regenerated catalyst 12 which brings about the catalytic cracking of uncracked hydrocarbons 6 thereby advancing the catalytic cracking process through said strata 1. Zone DB of FIG. 6 located downstream of both said regeneration zone AC and said newly established catalytic cracking zone CD is shown receiving inert gas 11 transporting heat *q*, cracked hydrocarbons 10 and $CO_2$ all which are absorbed by the uncracked hydrocarbons 6, found clinging to the pore 5 surfaces within zone DB of strata 1. This absorptin of heat, light hydrocarbons, and $CO_2$ improves the mobility of the uncracked hydrocarbons 6 by reducing their viscosity and surface tension. The $CO_2$ forms a solution phase with the hydrocarbons which improves the effectiveness of the gas drive mechanism inherent in said injection gas used in the process of the invention thereby causing a portion of said hydrocarbons 6 to be driven through said strata 1 toward said production well 3.

Repeating of said steps of catalytic cracking, catalyst stripping and catalyst regeneration advances said active zone AB through said strata 1 from said injection well 2 to said production well 3 thereby producing hydrocarbons from said earth strata 1.

Referring to FIG. 1 the initiation or start up of the process of this invention basically consists of preheating the strata in the vicinity of injection well 65 to a temperature range of 600° – 1050° F suitable for promoting and sustaining catalytic cracking of hydrocarbons found within said strata 1 to be produced. Initiation may be accomplished by delivering hot injection gases 68 to said strata 1 prior to and during the introduction of hydrocarbon cracking catalyst. Initiation may also be accomplished by first establishing in place combustion of the hydrocarbons in the vicinity of injection well 65 within said strata 1 by any of the methods commonly used followed by catalyst 79 injection into strata 1 via injection well 65. Examples of the numerous start up techniques available to the operator of the process of this invention will be detailed below and are summarized as:

A. Inert gas preheating, lining up $O_2$ containing gas and fuel gas to the injection well and using an ignitor system positioned in the injection well tubing to fire the hydrocarbon strata;

B. Inert gas heating to the temperature level required for catalytic cracking followed by regeneration with $O_2$ containing gas;

C. Inert gas heating of hydrocarbons followed by spontaneous combustion of hydrocarbons upon introducing $O_2$ containing gas followed by injection of catalyst;

D. Introducing hot $O_2$ containing gas for the purpose of bringing about hydrocarbon combustion followed by injecting catalyst into strata;

E. Introducing $O_2$ containing gas and fuel gas through the injection well, firing fuel gas by the ignitor to bring about combustion of hydrocarbons followed by injection of cracking catalyst;

F. Preheating with inert gas followed by introducing hot $O_2$ containing gas via the injection well annulus, fuel gas via the injection well tubing igniting fuel gas with an annulus placed ignitor to bring about firing of fuel gas from tubing thereby causing combustion of hydrocarbons in strata followed by catalyst addition; and, G. Introducing hot $O_2$ containing gas via the injection well annulus, fuel gas via the injection well tubing igniting fuel gas with an annulus placed ignitor to bring about firing of fuel gas from tubing thereby causing combustion of hydrocarbons in strata followed by catalyst addition.

Initiation of the process of this invention follows the strata pretreating, when required, and is hereinafter later discussed immediately following the description of the hydrocarbon cracking catalyst used in the process of this invention. Each of the previously summarized initiation techniques are described below:

A. Initiation by inert gas preheating, lining up $O_2$ containing gas and fuel gas to the injection well and using an ignitor system positioned in the injection well tubing to fire the hydrocarbon bearing strata. Referring to FIG. 1 gas analysis controller 16 set for inert gas operation opens inert gas control valve 14 and closes air intake control valve 15. Compressor 19 delivers pressurized inert gas to furnace 30 which heats the inert gas to the temperature required for injection into and preheating hydrocarbon bearing strata 1 flowing via injection well manifold 48, injection well tubing 50 and injection tubing slotted section 56. Introducing under pressure heated inert gases 68 through the perforated holes 5 in the casing 53 and cement 4 into said opposed hydrocarbon bearing strata 1 to preheat the immediate area of said hydrocarbon bearing strata 1 and the contained hydrocarbons to a temperature level sufficient to bring about a rapid ignition of in place hydrocarbons when $O_2$ containing gas is introduced into the strata 1 via the injection well 65; setting gas analysis controller 16 for $O_2$ containing gas operation thereby opening air intake valve 15, lining up fuel gas 47 to the injection well tubing 50, lining up $O_2$ containing injection gas 68 through the injection well annulus 70 via opened annulus flow block valve 35 and the adjustable casing packer 55, and activating the fuel gas/air ignitor system 76 by opening fuel gas valve 58 and air valve 59 and activating high voltage ignitor 75 thereby igniting the fuel gas 47 flowing from the slotted tubing section 56 effectively producing a fuel gas fired burner which under conditions of excess air available from the casing annulus 70 brings about burning of the hydrocarbons in said strata 1 in the immediate region of the injection well 65, shutting down fuel gas 47 flow through the injection well tubing 50, purging the tubing with an inert gas 77 for safety reasons, and opening valve 46 to establish flow of hot $O_2$ containing gas through said tubing 50 to support the in place burning of hydrocarbons located within said strata 1 in the immediate region of the injection well 65, closing said adjustable casing packer 55 to shut down flow through the annulus 70; and starting catalyst 79 injection carried by said $O_2$ containing injection gases 68 flowing through said injection tubing 50, through said slotted tubing section 56 and said casing and cement perforations 5 through the in-place hydrocarbon burning front within the strata 1 thereby delivering hot catalyst 79 with $O_2$ depleted combustion-product gases to heated hydrocarbons and establishing a catalytic hydrocarbon cracking zone; maintaining catalyst injection, carried by heated $O_2$ containing injection gas 68 through said tubing 50 and perforations 5 into said hydrocarbon bearing porous and permeable strata 1 thereby establishing a catalyst regeneration zone, a catalyst stripping zone a catalytic hydrocarbon cracking zone, a hydrocarbon preheating zone and a solution zone which are located in series within the hydrocarbon bearing strata 1 along the direction of flow from the injection well 65 to the production well 66.

B. Initiation by inert gas heating to temperature level required for catalytic cracking followed by catalyst regeneration using an $O_2$ containing gas. Referring to FIG. 1 gas analysis controller 16 set for inert gas operation opens inert gas control valve 14 and closes air intake control valve 15. Compressor 19 delivers pressurized inert gas to furnace 30 which heats the inert gas to the temperature required for injection and heating hydrocarbon bearing strata 1 flowing via injection well manifold 48, injection well tubing 50 and injection tubing slotted section 56. Introducing under pressure heated inert injection gases 68 through the perforated holes 5 in casing 53 and cement 4 into said opposed hydrocarbon bearing strata 1 to preheat the immediate area of said strata 1 and the contained hydrocarbons to a temperature level sufficient to support catalytic cracking of hydrocarbons; introducing finely divided catalyst 79 particles into said heated, pressurized and inert injection gas 68 stream such that the hot catalyst 79 is contacted with the heated hydrocarbons in place within said hydrocarbon bearing porous and permeable strata 1 thereby bringing about the catalytic cracking of large molecular weight hydrocarbons into smaller more flowable hydrocarbon reaction products and the catalytic cracking reaction co-products of coke on catalyst and cracking residue; and increase $O_2$ set point on gas analysis controller 16 which closes inert gas control valve 14 and opens air intake control valve 15 thereby raising the $O_2$ content of said heated, pressurized, catalyst-carrying injection gas 68 stream to a level suitable for burning the coke off the previously injected and deactivated catalyst which is bound by cracking residue to hydrocarbon-depleted pore surfaces within said strata 1 in the immediate region of the injection well 65 and to also burn the cracking residue binding the catalyst thereby freeing the regenerated catalyst so that said flowing injection gases 68 may pick up the regenerated catalyst and deliver it along with currently injected catalyst to a hydrocarbon containing location farther downstream within said strata 1 in order to repeat the catalytic hydrocarbon cracking, thereby advancing active zone AB of the process through said strata 1 from said injection well 65 to the production well 66.

C. Initiation by inert gas heating of hydrocarbons followed by spontaneous combustion of hydrocarbons upon introducing $O_2$ containing gas. Referring to FIG. 1 gas analysis controller 16 set for inert gas operation opens inert gas control valve 14 and closes air intake control valve 15. Compressor 19 delivers pressurized inert gas to the furnace 30 which heats the inert gas to the temperature required for injection and heating hydrocarbon bearing strata 1. Introducing under pressure inert injection gases 68 flowing downwardly through tubing 50 extending through casing 53 in the injection well 65, injection tubing slotted section 56, and perforations 5 into said oppositely opposed hydrocarbon bearing porous and permeable strata 1 to preheat the immediate area of said hydrocarbon bearing strata 1 and the contained hydrocarbons to a temperature level sufficient to bring about a spontaneous ignition of the hydrocarbons in place when the $O_2$ content is raised in the injection gas; setting gas analysis controller 16 for $O_2$ containing gas operation opening air intake control valve 15 and closing inert gas control valve 14, thereby raising the $O_2$ content of said heated, pressurized injection gas 68 stream to a level suitable for initiating ignition and combustion of the previously preheated hydrocarbons within said strata 1 in the immediate region of said injection well 65; and introducing finely divided catalyst 79 particles into said heated, pressurized $O_2$ containing injection gas stream 68 such that said hot catalyst 79, carried through the burning hydrocarbon front by said injection gas 68 depleted of $O_2$ in passage thru the combustion zone, contacts heated hydrocarbons within said hydrocarbon bearing porous and permeable strata 1 thereby establishing a catalytic cracking zone by bringing about the catalytic cracking of the heavier molecular weight hydrocarbons into lighter molecular weight more flowable hydrocarbon reaction products and the catalytic cracking co-products of coke on catalyst and cracking residue.

D. Initiation by introducing hot $O_2$ containing gas for purposes of bringing about spontaneous combustion of hydrocarbons. Referring to FIG. 1 gas analysis controller 16 set for $O_2$ containing gas operation opens air intake control valve 15 and closes inert gas control valve 14. Compressor 19 delivers pressurized $O_2$ containing gas to furnace 30 which heats the gas to the temperature required for injection and bringing about spontaneous combustion of the hydrocarbons found in the strata 1 in the proximity of the injection well 65. Introducing under pressure heated $O_2$ containing injection gases 68 flowing downwardly through tubing 50 extending through casing 53 in the injection well 65, injection tubing slotted section 56 and perforations 5 into said oppositely opposed hydrocarbon bearing porous and permeable strata 1 to preheat the immediate area of said hydrocarbon bearing strata 1 and contained hydrocarbons to a temperature level to bring about spontaneous combustion of the hydrocarbons in place; and introducing finely divided catalyst 79 particles into said heated, pressurized $O_2$ containing injection gas stream 68 such that said hot catalyst 79, carried through the burning hydrocarbon front by said injection gas 68 depleted of $O_2$ in flowing thru the burning zone, contacts heated hydrocarbons in place within said hydrocarbon bearing porous and permeable strata 1 thereby establishing a catalytic cracking zone by bringing about the catalytic cracking of the heavier molecular weight hydrocarbons into lighter molecular weight more flowable hydrocarbon reaction products and the catalytic cracking coproducts of coke on catalyst and cracking residue.

E. Initiation by introducing $O_2$ containing gas and fuel gas through the injection well, using an ignitor system to fire the fuel gas bringing about combustion of the hydrocarbons. Referring to FIG. 1 gas analysis controller 16 set for $O_2$ containing gas operation opens air intake control valve 15 and closes inert gas control valve 14. Compressor 19 delivers pressurized $O_2$ containing gas to furnace 30 which heats the gas to a temperature suitable for injection. Introducing heated and pressurized $O_2$ containing injection gas 68 to strata 1 via opened annulus flow block valve 35, tubing-casing annulus 70, opened adjustable packer 55; closing mix drum outlet block valve 46 and introducing fuel gas 47 via injection well tubing manifold 48, injection tubing 50 and tubing slotted section 56 oppositely opposed hydrocarbon bearing strata 1; activating the ignitor system 76 by opening fuel gas valve 58, air valve 59, ignitor tube block valve 61 and activating high voltage ignitor 75, the ignitor tube 57 extends downwardly through injection well tubing 50 and bottoms oppositely opposed injection tubing slotted section 56; ignition of said fuel gas 47 flowing from said tubing slotted section 56 converts the slotted section into a burner which under condition of excess air brings about combustion of the hydrocarbons within the strata 1 adjacent the injection well 65; once in-strata combustion of hydrocarbons is established fuel gas 47 flow through said tubing 50 is replaced with hot $O_2$ containing gas 68 after first purging the fuel gas from said injection tubing 50 with an inert gas 77 for safety purposes, $O_2$ containing gas flow through said annulus 70 is stopped and heating of the strata 1 is continued by in place burning of hydrocarbons; and after heating strata 1 adjacent the injection well 65 to a temperature suitable for initiating and establishing catalytic cracking of hydrocarbons, injection of hydrocarbon cracking catalyst 79 is started, transported to said strata 1 by said $O_2$ containing injection gas 68 thereby establishing a catalytic hydrocarbon cracking zone.

F. Initiation by preheating with inert gas followed by introducing $O_2$ containing gas via the injection well annulus and fuel gas via the injection well tubing and igniting the fuel gas with an ignitor extending downwardly through said annulus and bottoming oppositely opposed said slotted tubing section. Referring to FIG. 1 gas analysis controller 16 set for inert gas operation opens inert gas control valve 14 and closes air intake control valve 15. Compressor 19 delivers pressurized inert gas to furnace 30 which heats the gas to a temperature suitable for injection via injection well 65 to hydrocarbon bearing strata 1. Introducing under pressure heated inert injection gases 68 downwardly into and through tubing 50, slotted tubing section 56 and perforations 5 extending through casing 53 into oppositely opposed said hydrocarbon bearing strata 1; setting gas analysis controller 16 for $O_2$ containing gas operation thereby opening air intake valve 15, lining up fuel gas 47 to the injection well tubing 50, lining up $O_2$ containing injection gas 68 through the injection well annulus 70 via opened annulus flow block valve 35 and activating annulus positioned ignitor system 76 shown in FIG. 2 by opening ignitor fuel gas valve 58 and air valve 59 and activating high voltage ignitor 75 thereby igniting the fuel gas 47 flowing from the slotted tubing section 56 effectively producing a fuel gas fired burner which under conditions of excess air available from the casing annulus 70 brings about burning of the hydrocarbons in said strata 1 in the immediate region of said injection well 65; shutting down fuel gas 47 flow through the injection well tubing 50, purging the tubing with an inert gas 77 for safety reasons, and opening valve 46 to establish flow of hot $O_2$ containing gas through said tubing 50 to support the in place burning of hydrocarbons located within said strata 1 in the immediate region of the injection well 65, closing annulus flow block valve 35 to shut down flow through the annulus 70; and starting catalyst particles 79 injection carried by the $O_2$ containing injection gases 68 flowing through said tubing 50, through said slotted tubing section 56 and said casing 53, perforation 5 into said hydrocarbon bearing strata 1 flowing past the in-place hydrocarbon burning front within the strata 1 thereby delivering hot catalyst 79 transported by injection gas depleted of $O_2$ in flowing through the combustion zone to heated hydrocarbons and establishing a catalytic hydrocarbon cracking zone and, G. Initiation by introducing $O_2$ containing gas via injection well annulus, fuel gas via the injection well tubing and igniting the fuel gas with an ignitor extending downwardly through said annulus and bottoming oppositely opposed said slotted tubing section as shown in FIG. 2. Referring to FIG. 1 gas analysis controller 16 set for $O_2$ containing gas operation opens air intake control valve 15 and closes inert gas control valve 14. Compressor 19 delivers pressurized inert gas to furnace 30 which heats the gas to a temperature suitable for injection into hydrocarbon bearing strata 1. Introducing heated and pressurized $O_2$ containing injection gas 68 to said strata 1 via opened annulus flow block valve 35, tubing-casing annulus 70; closing mix drum outlet block valve 46 and introducing fuel gas 47 via injection well tubing manifold 48, injection tubing 50 and tubing slotted section 56 oppositely opposed hydrocarbon bearing strata 1; referring to FIG. 2 activating the ignitor system 76 by opening fuel gas valve 58, air valve 59, ignitor tube block valve 61 and activating high voltage ignitor 72, ignitor tube 57 extends downwardly through injection well annulus 70 and bottoms oppositely opposed injection tubing slotted section 56; ignition of the fuel gas flowing from the tubing slotted section converts the slotted section into a burner which under condition of excess air brings about the combustion of the hydrocarbons within said strata 1 adjacent the injection well 65; referring to FIG. 1 once in strata combustion of hydrocarbons is established fuel gas 47 flow through the tubing 50 is replaced with hot $O_2$ containing gas flow after purging the fuel gas from the tubing with an inert gas 77 for safety purposes, $O_2$ containing gas flow through the annulus 70 is stopped and heating of the strata 1 is continued by in place burning of hydrocarbons; and after heating strata 1 adjacent the injection well 65 to a temperature suitable for initiating and establishing catalytic cracking of hydrocarbons, injection of hydrocarbon cracking catalyst 79 is started, transported to said strata 1 by said $O_2$ containing injection gas 68 thereby establishing a catalytic hydrocarbon cracking zone.

Catalyst 79 used in the process of this invention shall be material having hydrocarbon cracking catalytic activity and capable of being regenerated by burning the deactivating deposits of coke which are formed on the catalyst surfaces as a coproduct in the hydrocarbon cracking reaction. This catalyst may be any of the catalyst varieties conventionally employed in fluid catalytic cracking units of the petroleum refining industry. For example, catalyst used are natural clay, synthetic clay, silica, alumina, mixtures of silica and alumina gels, mixtures of silica and alumina gels containing synthesized aluminosilicate zeolites. These crystalline aluminosilicate zeolites having a structure similar to the naturally occurring faujasite have rare earth metal ions such as zirconium substituted for a portion of the sodium ions located in the crystalline structure. Table 1, hereinafter shown, gives the chemical composition of a typical aluminosilicate zeolite hydrocarbon cracking catalyst.

TABLE I

| CHEMICAL ANALYSIS: wt. %, dry basis | |
|---|---|
| SILICA ($SiO_2$) | 66.3 |
| ALUMINA ($Al_2O_3$) | 28.6 |
| SODIUM OXIDE ($Na_2O$) | .57 |
| IRON (Fe) | .09 |
| LOSS ON IGNITION (1500° F.) | 12.9 |

Found in literature are many discussions of zeolite or molecular sieve hydrocarbon cracking catalyst. The following is a partial list of applicable references to molecular sieve cracking catalyst:

Baker et al., "Synthetic Foujasite — The Molecular Sieve for Fluid Cracking Catalyst" RM-67-77, Sept., 1967, National Petroleum Refiners Association.

Pickert, P. E., "The Role of Molecular Sieves in Cracking Catalysts" 26 – 68, May, 1968, American Petroleum Institue.

Ebel, R. H., "Sieve Properties Can Yield Superior Cracking catalysts", Apr., 1968, The Oil and Gas Journal.

The size of the finely divided catalyst particles used in the process of this invention must meet two important criteria:

1. The catalyst particle must be sufficiently small to easily flow through the pore spaces of the hydrocarbon bearing earth strata to be produced, and 2. The terminal velocity of the finely divided catalyst particles must be sufficiently lower than the gas velocities experienced in the strata during operation of the process of the invention. For these reasons the size of the catalyst particles used in the process of this invention and the individual hydrocarbon bearing strata's geological data are carefully evaluated prior to initiation of the process. Catalyst sizing equipment such as that of Fluid Energy Co. jet mill as shown and described in catalogue No. M2 dated 5M74, are required in many applications of the process of this invention to produce submicron catalyst particles which approach BROWNIAN MOVEMENT flow characteristics.

In the case of aluminosilicate zeolite rare earth catalyst permanent deactivation or poisoning is caused by sodium ion contamination. For this reason pretreating of the strata with steam and/or deionized water is used to flush sodium ions away from the strata adjacent the injection well. The use of steam and/or deionized water which have extremely low Na + ion (sodium) concentration is critical to the successful pretreatment flushing of the hydrocarbon bearing strata. Referring to FIG. 1, techniques used to pretreat the strata are discussed below:

A. Pressurized deionized water 99 is lined up to the injection well tubing manifold 48 by opening deionized water valve 100. The deionized water flows down injection well tubing 50 and into and through strata 1 toward production well 66. Sodium content of produced water is analyzed to determine the duration of deionized water injection.

B. Steam 97 is lined up to the injection well tubing manifold 48 by opening steam valve 98. The steam flows down injection well tubing 50 and into and through strata 1 toward production well 66. Sodium content of produced water is analyzed to determine the duration of the steam displacement.

C. A combination technique of first injecting deionized water 99 into strata 1 followed by a steam 97 injection to displace sodium ions from the strata region to be catalytically produced.

Once the strata has been purposely wet with water or steam in pretreating or if geological data indicate, the placing of an initial catalyst charge into the strata by means of a catalyst slurry may be utilized. The catalyst slurry placement in the strata 1 is accomplished either after the deionized water flood, after the steam displacement or before the initial strata heatup step of initiating the process is begun.

Referring to FIG. 1, charging the strata 1 with a catalyst slurry is accomplished by the following steps:

Flowing finely divided catalyst particles 79 stored in catalyst storage bin 36 to catalyst slurring mixer 40 using pressurized dry bulk feeder 39. Flowing slurry fluid 78 to the catalyst slurrying mixer via slurrying mixer via slurrying fluid flow measuring element 110 and flow control valve 41. Pumping the catalyst slurry to the injection well tubing manifold 48 using catalyst slurry pump 43 via slurry supply pipe 42 and block valve 101. The slurried catalyst flows downwardly through injection well tubing 50 through injection well casing and cement perforations 5 into the oppositely opposed hydrocarbon bearing strata 1.

The capability of delivering catalyst slurry from the slurrying mixer 40 to the mix drum 45 by the slurry pump 43 is available via pipe 42 and block valve 44. This permits the mixing of a catalyst slurry with hot injection gases both of which are delivered to strata 1 when dictated by the response of a particular strata/hydrocarbon system to the operation of the process of this invention.

Depending upon the response of the particular hydrocarbon reservoir system to the process of this invention, reference is here made to FIG. 1 wherein steam 97 may be introduced via valve 98 located on injection well manifold 48 into hot $O_2$ containing injection gas 68, with or without catalyst 79 present. This admixture of steam and hot $O_2$ containing injection gas, with or without catalyst is then delivered under pressure into the hydrocarbon bearing strata 1.

In the operation of the process of this invention control of the strata 1 back pressure would be advantageous. Referring to FIG. 2, this is accomplished by operating the production well pumping unit 83 and production separator 84 off gas vacuum pump 85.

In the operation of the process of this invention the response of the strata 1 may dictate the need to pulse or reverse flow in the strata for a short duration of time. Referring to FIG. 1, reverse flowing is accomplished by opening vent valve 103 allowing flow through atmospheric vent 102 located in communication with the injection well tubing manifold 48 thereby relieving the system pressure to atmosphere then resuming normal operations of the process of this invention.

An impervious material such as cement or the like, may be used to fill and seal the annulus between the casing 53 and the well bore 111 of the injection well in order to prevent invasion of undesired fluid from above or below the hydrocarbon strata to be produced by the process of this invention, and, also to prevent the bypassing of the strata by said injection gases and catalyst introduced via the injection well to said strata 1.

It is to be understood, that a plurality of injection wells and a plurality of production wells may be arranged and positioned in various patterns to each other utilizing the processes of this invention to free in place hydrocarbons and recover the production of such freed hydrocarbons in said production wells. The use of one injection well and one production well throughout the description of this invention is used as an example only.

It is obvious that many changes may be made in the combination of parts and elements whereby my basic process may be accomplished as shown, described and claimed herein without departing from the spirit and scope of the invention.

Having thus described the invention, what I claim as new and desire to secure by Letters Patent, is:

1. A multi-step process operated at suitable pressure and temperature for catalytically producing hydrocarbons from porous and permeable hydrocarbon bearing earth strata in which is established a catalytic hydrocarbon cracking zone, a catalyst stripping zone, a catalyst regeneration zone wherein the process uses at least one injection well and at least one production well both completed in the same hydrocarbon bearing porous and permeable earth strata through which is established a flow direction of injection gas, hydrocarbon cracking catalyst and freed hydrocarbons from injection well to production well, introducing into said strata via said injection well under pressure a heated $O_2$ containing gas and a hydrocarbon cracking catalyst into a catalyst regeneration zone of said strata, said gas having sufficient $O_2$ concentration to burn coke off previously injected and deactivated catalyst and to burn the cracking residue which binds said deactivated catalyst to the walls of said strata pores thereby freeing the regenerated catalyst particles allowing said regenerated catalyst to enter the gas stream flowing downstream in the direction of successive functional zones within said strata, flowing the hot injection gases, depleted of $O_2$ in said catalyst regeneration zone and transporting both said surface-injected catalyst and regenerated catalyst, through said stripping zone containing coked catalyst bound to pore surfaces by cracking residue so as to strip volatile hydrocarbons from said coke, deactivated catalyst and cracking residue, delivering both said surface-injected catalyst, regenerated catalyst and heat to said catalytic hydrocarbon cracking zone wherein active catalyst contacts and adsorbs large hydrocarbon molecules clinging to the pore surfaces of said strata and causes said hydrocarbons to crack into smaller more mobile molecules which desorb from the catalyst and enter the gas stream flowing downstream through said strata toward said production well, flowing hot gas, combustion products and catalytic cracking hydrocarbon products leaving said catalytic cracking zone through a hydrocarbon preheating zone within said strata which absorbs heat from the flowing gas stream, flowing the now cooled gases into a solution zone containing uncracked hydrocarbons which receive the condensing cracked hydrocarbon products and also the $CO_2$ produced in said catalyst regeneration zone, thereby making said uncracked hydrocarbons more susceptible to being driven by said gas drive by reducing said hydrocarbon viscosity and surface tension and forming solution phases such that a portion of said uncracked hydrocarbons move downstream through said strata toward said production well.

2. A multi-step process operated at suitable pressure and temperature for catalytically producing hydrocarbon from porous and permeable hydrocarbon bearing earth strata in which is established a catalytic hydrocarbon cracking zone wherein the process uses at least one injection well and at least one production well both completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and thru said injection well and into said strata,
2. introducing a slurry of finely divided hydrocarbon cracking catalyst and slurrying fluid into and thru said injection well and into said strata, and
3. introducing into said strata via said injection well under pressure a heated $O_2$ containing gas and a hydrocarbon cracking catalyst.

3. A multi-step process operated at suitable pressure and temperature for catalytically producing hydrocarbon from porous and permeable hydrocarbon bearing earth strata in which is established a catalytic hydrocarbon cracking zone wherein the process uses at least one injection well and at least one production well both completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and through said injection well and into said strata and
2. introducing into said strata via said injection well under pressure a heated $O_2$ containing gas and a hydrocarbon cracking catalyst.

4. A multi-step process operated at suitable pressure and temperature for catalytically producing hydrocarbon from porous and permeable hydrocarbon bearing earth strata in which is established a catalytic hydrocarbon cracking zone wherein the process uses at least one injection well and at least one production well both completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and thru said injection well and into said strata,
2. introducing a steam flow into and thru said injection well and into said strata and
3. introducing into said strata via said injection well under pressure a heated $O_2$ containing gas and a hydrocarbon cracking catalyst.

5. A multi-step process operated at suitable pressure and temperature for catalytically producing hydrocarbon from porous and permeable hydrocarbon bearing earth strata in which is established a catalytic hydrocarbon cracking zone wherein the process uses at least one injection well and at least one production well, both completed in said hydrocarbon bearing porous and permeable earth strata through which is established a flow direction of injection gas, hydrocarbon cracking catalyst and freed hydrocarbons from injection well to production well, steps of said process include:

1. introducing a steam flow into and thru said injection well and into said strata,
2. introducing a slurry of finely divided hydrocarbon cracking catalyst and slurrying fluid into and thru said injection well and into said strata and
3. introducing into said strata via said injection well under pressure a heated $O_2$ containing gas and a hydrocarbon cracking catalyst.

6. A multi-step process operated at suitable pressure and temperature for catalytically producing hydrocarbon from porous and permeable hydrocarbon bearing earth strata in which is established a catalytic hydrocarbon cracking zone wherein the process uses at least one injection well and at least one production well both completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and thru said injection well and into said strata,
2. introducing a steam flow into and thru said injection well and into said strata and
3. introducing a slurry of finely divided hydrocarbon cracking catalyst and slurrying fluid into and thru said injection well and into said strata,
4. introducing into said strata via said injection well under pressure a heated $O_2$ containing gas and a hydrocarbon cracking catalyst.

7. A multi-step process operated at suitable pressure and temperature for catalytically producing hydrocarbon from porous and permeable hydrocarbon bearing earth strata in which is established a catalytic hydrocarbon cracking zone wherein the process uses at least one injection well and at least one production well both completed in said hydrocarbon bearing porous and permeable earth strata through which is established a flow direction of injection gas, hydrocarbon cracking catalyst and freed hydrocarbons from injection well to production well, steps of said process include:

1. introducing a steam flow into and thru said injection well and into said strata and
2. introducing into said strata via said injection well under pressure a heated $O_2$ containing gas and a hydrocarbon cracking catalyst.

8. A multi-step process operated at suitable pressure and temperature for catalytically producing hydrocarbon from porous and permeable hydrocarbon bearing earth strata in which is established a catalytic hydrocarbon cracking zone wherein the process uses at least one injection well and at least one production well both completed in said hydrocarbon bearing porous and permeable earth strata through which is established a flow direction of injection gas, hydrocarbon cracking catalyst and freed hydrocarbons from injection well to production well, steps of said process include:

1. introducing a slurry of finely divided hydrocarbon cracking catalyst and slurrying fluid into and thru said injection well and into said strata and
2. introducing into said strata via said injection well under pressure a heated $O_2$ containing gas and a hydrocarbon cracking catalyst.

9. A multi-step process for catalytically producing hydrocarbons from porous and permeable hydrocarbon bearing earth strata wherein the process utilizes at least one injection well equipped with ignitor and slotted tubing section opposing said strata and at least one production well both completed in the same hydrocarbon bearing porous and permeable earth strata through which is established a flow direction of injection gas, hydrocarbon cracking catalyst and freed hydrocarbons through said strata from injection well to said production well, including the steps of introducing heated inert gas under pressure into and through said injection well and into said strata for preheating said strata, introducing $O_2$ containing heated gas and fuel gas under pressure into and through said injection well and into said strata preparatory to igniting the hydrocarbons in said strata, activating the ignitor to ignite the fuel gas to burn through the slotted section of tubing, said casing and cement perforations opposed thereto and cause combustion of the hydrocarbons in the strata adjacent thereto, shutting down the fuel gas supply and continuing the heated and pressurized $O_2$ containing gas flow into said strata, start adding hydrocarbon cracking catalyst into the $O_2$ containing gas to deliver said catalyst into the hydrocarbon bearing strata thereby bringing about catalytic hydrocarbon cracking within the strata to crack larger immobile hydrocarbon molecules into smaller more mobile hydrocarbon molecules, regenerating said catalyst by burning the coke from the deactivated catalyst when the oxygen content of the gas contacting the deactivated catalyst is sufficiently high to bring about the burning of the coke deposited on the catalyst and to burn the cracking residue binding the catalyst to the pore surfaces of said strata thereby freeing the regenerated catalyst to enter the gas flow stream thereby advancing the hydrocarbon cracking front through the strata toward the production well, controlling the temperature, $O_2$ content and catalyst content of said heated and pressurized $O_2$ containing gas flow to maintain suitable temperature in said strata to promote and advance continued catalytic cracking of said hydrocarbons in said strata and regeneration of said deactivated catalyst therein and providing a pressurized gas sweep which drives freed cracked hydrocarbons and those uncracked hydrocarbons having improved mobility as a result of their absorbing heat, cracked hydrocarbons and $CO_2$ through said strata toward and through the opposed casing perforations in said production well.

10. A multi-step process for catalytically producing hydrocarbons from porous and permeable hydrocarbon bearing earth strata wherein the process utilizes at least one injection well and at least one production well both completed in the same hydrocarbon bearing porous and permeable earth strata through which is established a flow direction of injection gas, hydrocarbon cracking catalyst and freed hydrocarbons through said strata from injection well to said production well, including the steps of introducing $O_2$ containing heated gas under pressure into and through said injection well and into said strata for purpose of spontaneously igniting the hydrocarbons in said strata, start adding hydrocarbon cracking catalyst into the $O_2$ containing gas flow to deliver said catalyst into the hydrocarbon bearing strata thereby bringing about catalytic hydrocarbon cracking within the strata to crack larger immobile hydrocarbon molecules into smaller more mobile hydrocarbon molecules, regenerating said catalyst by burning the coke from the deactivated catalyst when the oxygen content of the gas contacting the deactivated catalyst is sufficiently high to bring about the burning of the coke deposited on the catalyst and to burn the cracking residue binding the catalyst to the pore surfaces of said strata thereby freeing the regenerated catalyst to enter the gas flow stream thereby advancing the hydrocarbon cracking front through the strata toward the production well, controlling temperature $O_2$ content and catalyst content of said heated and pressurized $O_2$ containing gas flow to maintain suitable temperature in said strata to promote and advance continued catalytic cracking of said hydrocarbons in said strata and regeneration of said deactivated catalyst therein and providing a pressurized gas sweep which drives freed cracked hydrocarbons and those uncracked hydrocarbons having improved mobility as a result of their absorbing heat, cracked hydrocarbons and $CO_2$ through said strata toward and through the opposed casing perforations in said production well.

11. A multi-step process for catalytically producing hydrocarbons from porous and permeable hydrocarbon bearing earth strata wherein the process utilizes at least one injection well and at least one production well both completed in the same hydrocarbon bearing porous and permeable earth strata through which is established a flow direction of injection gas, hydrocarbon cracking catalyst and freed hydrocarbons through said strata from injection well to said production well including the steps of introducing heated inert gas under pressure into and through said injection well and into said strata for heating said strata, shutting down the inert gas supply and starting heated and pressurized $O_2$ containing gas flow into said strata initiating hydrocarbon combustion therein, start adding hydrocarbon cracking catalyst into the $O_2$ containing gas to deliver said catalyst into the hydrocarbon bearing strata thereby bringing about catalytic hydrocarbon cracking within the strata to crack larger immobile hydrocarbon molecules into smaller more mobile hydrocarbon molecules, regenerating said catalyst by burning the coke from the deactivated catalyst when the oxygen content of the gas contacting the deactivated catalyst is sufficiently high to bring about the burning of the coke deposited on the catalyst and to burn the cracking residue binding the catalyst to the pore surfaces of said strata thereby freeing the regenerated catalyst to enter the gas flow stream thereby advancing the hydrocarbon cracking front through said strata toward the production well, controlling the temperature, $O_2$ content and catalyst content of said heated and pressurized $O_2$ containing gas flow to maintain suitable temperature in said strata to promote and advance continued catalytic cracking of said hydrocarbons in said strata and regeneration of said deactivated catalyst therein and providing a pressurized gas sweep which drives freed cracked hydrocarbons and those uncracked hydrocarbons having improved mobility as a result of their absorbing heat, cracked hydrocarbons and $CO_2$ through said strata toward and through opposed casing perforations in said production well.

12. A multi-step process for catalytically producing hydrocarbons from porous and permeable hydrocarbon bearing earth strata wherein the process utilizes at least one injection well and at least one production well both completed in the same hydrocarbon bearing porous and permeable earth strata through which is established a flow direction of injection gas hydrocarbon cracking catalyst and freed hydrocarbons through said strata from injection well to said production well, including the steps of introducing heated inert gas under pressure into and through said injection well and into said strata for preheating said strata, start adding hydrocarbon cracking catalyst into the hot inert gas flow to deliver said catalyst into the hydrocarbon bearing strata thereby bringing about catalytic hydrocarbon cracking within the strata to crack larger immobile hydrocarbon molecules into smaller more mobile hydrocarbon molecules, replacing said hot inert gas flow with heated and pressurized $O_2$ containing gas flow to said strata, regenerating said catalyst by burning the coke from the deactivated catalyst when the oxygen content of the gas contacting the deactivated catalyst is sufficiently high to bring about the burning of the coke deposited on the catalyst and to burn the cracking residue binding the catalyst to the pore surfaces of said strata thereby freeing the regenerated catalyst to enter the gas flow stream thereby advancing the hydrocarbon cracking front through the strata toward the production well, controlling the temperature, $O_2$ content and catalyst content of said heated and pressurized $O_2$ containing gas flow to maintain suitable temperature in said strata to promote and advance continued catalytic cracking of said hydrocarbons in said strata and regeneration of said deactivated catalyst therein and providing a pressurized gas sweep which drives freed cracked hydrocarbons and those uncracked hydrocarbons having improved mobility as a result of their absorbing heat, cracked hydrocarbons and $CO_2$ through said strata toward and through the opposed casing perforations in said production well.

13. A multi-step process for catalytically producing hydrocarbons from porous and permeable hydrocarbon bearing earth strata wherein the process utilizes at least one injection well equipped with ignitor and slotted tubing section opposing said strata and at least one production well both completed in said hydrocarbon bearing porous and permeable earth strata through which is established a flow direction of injection gas hydrocarbon cracking catalyst and freed hydrocarbons through said strata from injection well to said production well, including the steps of introducing $O_2$ containing heated gas and fuel gas under pressure into and through said injection well and into said strata preparatory to igniting the hydrocarbons in said strata, actuating said ignitor to ignite the fuel gas to burn through the slotted section of tubing and cause combustion of the hydrocarbons in the strata adjacent thereto, shutting down the fuel gas supply and continuing the heated and pressurized $O_2$ containing gas flow into said strata, start adding hydrocarbon cracking catalyst into the $O_2$ containing gas to deliver said catalyst into the hydrocarbon bearing strata thereby bringing about catalytic hydrocarbon cracking within the strata to crack larger immobile hydrocarbon molecules into smaller more mobile hydrocarbon molecules, regenerating said catalyst by burning the coke from the deactivated catalyst when the oxygen content of the gas contacting the deactivated catalyst is sufficiently high to bring about the burning of the coke deposited on the catalyst and to burn the cracking residue binding the catalyst to the pore surfaces of said strata thereby freeing the regenerated catalyst to enter the gas flow stream thereby advancing the hydrocarbon cracking front through the strata toward the production well, controlling the temperature, $O_2$ content and catalyst content of said heated and pressurized $O_2$ containing gas flow to maintain suitable temperature in said strata to promote and advance continued catalytic cracking of said hydrocarbons in said strata and regeneration of said deactivated catalyst therein and providing a pressurized gas sweep which drives freed cracked hydrocarbons and those uncracked hydrocarbons having improved mobility as a result of their absorbing heat, cracked hydrocarbons and $CO_2$ through said strata toward and through the opposed casing perforations in said production well.

14. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gases, hydrocarbon cracking catalyst and freed hydrocarbons from injection well to production well, the steps of said process include:

1. introducing an active hydrocarbon cracking catalyst carried by a heated inert gas delivered under pressure via the injection well into said catalytic hydrocarbon cracking zone located within said hydrocarbon bearing earth strata in communication with said injection well wherein said acitve catalyst contacts and adsorbs large hydrocarbon molecules clinging to the pore surfaces of said strata causing said large hydrocarbon molecules to crack into smaller more mobile molecules which desorb from said catalyst and enter the gas stream flowing downstream through said strata toward the production well, also formed are catalytic cracking reaction coproducts of coke and cracking residue;
2. delivering via said injection well hot inert gas singularly into the hydrocarbon depleted previous catalytic hydrocarbon cracking zone within the strata wherein the coked catalyst bound by cracking residue to said strata pore surfaces is effectively stripped of any volatile hydrocarbons which enter the gas stream flowing through the strata in the direction of the production well;
3. delivering via the injection well hot gas containing oxygen at a suitable $O_2$ concentration to the previously cracked and stripped zone within said strata so as to bring about the in place regeneration of said deactivated catalyst by the burning of both the coke deposits on said catalyst and the cracking residue binding said deactivated catalyst so that it may be delivered, by the hot now $O_2$ depleted gas, to a new hydrocarbon cracking site downstream within said strata in a flow direction from injection well to production well; and,
4. repeating the said process steps (1), (2) and (3) in the order above described further advances the catalytic hydrocarbon cracking process through the strata, bringing about increased hydrocarbon recovery from said strata flowing toward and into said production well and available to be recovered from said production well.

15. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, one step of the process includes introducing an active hydrocarbon cracking catalyst carried by a heated inert gas delivered under pressure via the injection well, into said catalytic hydrocarbon cracking zone located within said hydrocarbon bearing earth strata in communication with said injection well wherein said active catalyst contacts and adsorbs large hydrocarbon molecules clinging to said pore surfaces of said strata causing said large hydrocarbon molecules to crack into smaller more mobile molecules which desorb from said catalyst and enter the gas stream flowing downstream through said strata toward said production well, also formed are catalytic cracking reaction coproducts of coke and cracking residue.

16. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of the process include: stopping the addition of hydrocarbon cracking catalyst into the hot inert injection gas and continue delivering via said injection well hot inert gas singularly into the hydrocarbon depleted previous said catalytic hydrocarbon cracking zone within said strata wherein the coked catalyst bound by cracking residue to said strata pore surfaces is effectively stripped of any volatile hydrocarbons which enter the gas stream flowing through the strata in the direction of the production well.

17. A multi-step process operated at suitable pressure and temperature for catalytically producing hydrocarbons from porous and permeable hydrocarbon bearing earth strata in which is established a catalytic hydrocarbon cracking zone, a catalyst stripping zone, a catalyst regeneration zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, one step of the process includes delivering hot gas containing oxygen at a suitable concentration to the previously cracked and stripped zone within said strata so as to bring about the in place regeneration of said previously injected hydrocarbon cracking catalyst by the burning of both the coke deposits on said catalyst and the cracking residue binding said deactivated catalyst to said strata pore surfaces thereby freeing regenerated catalyst so that it may be delivered, by the hot now $O_2$ depleted gas, to a new hydrocarbon cracking site downstream within said strata.

18. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and through said injection well and into said strata and
2. introducing an active hydrocarbon catalyst carried by a heated inert gas delivered under pressure via the injection well, into said hydrocarbon strata catalytic hydrocarbon cracking zone in communication with said injection well wherein said active catalyst contacts and adsorbs large hydrocarbon molecules clinging to said pore surfaces of said strata and cause said large hydrocarbon molecules to crack into smaller more mobile molecules which desorb from said catalyst and enter the gas stream flowing downstream through the strata toward the production well, also formed are catalytic cracking reaction coproducts of coke and cracking residue.

19. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and thru said injection well and into said strata and
2. introducing a steam flow into and thru said injection well and into said strata
3. introducing an active hydrocarbon cracking catalyst carried by a heated inert gas delivered under pressure via the injection well, into said hydrocarbon strata catalytic hydrocarbon cracking zone in communication with said injection well wherein said active catalyst contacts and adsorbs large hydrocarbon molecules clinging to said pore surfaces of said strata and cause said large hydrocarbon molecules to crack into smaller more mobile molecules which desorb from said catalyst and enter the gas stream flowing downstream through the strata toward the production well, also formed are catalytic cracking reaction coproducts of coke and cracking residue.

20. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and thru said injection well and into said strata,
2. introducing a slurry of finely divided hydrocarbon cracking catalyst and slurrying fluid into and thru said injection well and into said strata and
3. introducing an active hydrocarbon catalyst carried by a heated inert gas delivered under pressure via the injection well, into said hydrocarbon strata catalytic hydrocarbon cracking zone in communication with said injection well wherein said active catalyst contacts and adsorbs large hydrocarbon molecules clinging to said pore surfaces of said strata and cause said large hydrocarbon molecules to crack into smaller more mobile molecules which desorb from said catalyst and enter the gas stream flowing downstream through the strata toward the production well, also formed are catalytic cracking reaction coproducts of coke and cracking residue.

21. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of said process include:

1. introducing a deionized water injection into and thru said injection well and into said strata,
2. introducing a steam flow into and thru said injection well and into said strata,
3. introducing a slurry of finely divided hydrocarbon cracking catalyst and slurrying fluid into and thru said injection well and into said strata and
4. introducing an active hydrocarbon cracking catalyst carried by a heated inert gas delivered under pressure via the injection well, into said hydrocarbon strata catalytic hydrocarbon cracking zone in communication with said injection well wherein said active catalyst contacts and adsorbs large hydrocarbon molecules clinging to said pore surfaces of said strata and cause said large hydrocarbon molecules to crack into smaller more mobile molecules which desorb from said catalyst and enter the gas stream flowing downstream through the strata toward the production well, also formed are catalytic cracking reaction coproducts of coke and cracking residue.

22. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of said process include:

1. introducing a steam flow into and thru said injection well and into said strata and
2. introducing an active hydrocarbon cracking catalyst carried by a heated inert gas delivered under pressure via the injection well, into said hydrocarbon strata catalytic hydrocarbon cracking zone in communication with said injection well wherein said active catalyst contacts and adsorbs large hydrocarbon molecules clinging to said pore surfaces of said strata and cause said large hydrocarbon molecules to crack into smaller more mobile molecules which desorb from said catalyst and enter the gas stream flowing downstream through the strata toward the production well, also formed are catalytic reaction coproducts of coke and cracking residue.

23. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of said process include:

1. introducing a steam flow into and thru said injection well and into said strata,
2. introducing a slurry of finely divided hydrocarbon cracking catalyst and slurrying fluid into and thru said injection well and into said strata and
3. introducing an active hydrocarbon cracking catalyst carried by a heated inert gas delivered under pressure via the injection well, into said hydrocarbon strata catalytic hydrocarbon cracking zone in communication with said injection well wherein said active hydrocarbon cracking catalyst contacts and adsorbs large hydrocarbon molecules clinging to said pore surfaces of said strata cause said large hydrocarbon molecules to crack into smaller more mobile molecules which desorb from said catalyst and enter the gas stream flowing downstream through the strata toward the production well, also formed are catalytic cracking reaction coproducts of coke and cracking residue.

24. A multi-step process operated at suitable pressure and temperature for catalytically producing hydrocarbons from porous and permeable hydrocarbon bearing earth strata in which is established a catalytic hydrocarbon cracking zone wherein the process uses at least one injection well and at least one production well completed in said hydrocarbon bearing porous and permeable earth strata through which is established a flow direction of injection gas, hydrocarbon cracking catalyst and freed hydrocarbons from injection well to production well, steps of said process include:

1. introducing a slurry of finely divided hydrocarbon cracking catalyst and slurrying fluid into and thru said injection well and into said strata and
2. introducing an active hydrocarbon cracking catalyst carried by a heated inert gas delivered under pressure via the injection well, into said hydrocarbon strata catalytic hydrocarbon cracking zone in communication with said injection well wherein said active hydrocarbon cracking catalyst contacts and adsorbs large hydrocarbon molecules clinging to said pore surfaces of said strata and cause said large hydrocarbon molecules to crack into smaller more mobile molecules which desorb from said catalyst and enter the gas stream flowing downstream through the strata toward the production well, also formed are catalytic reaction coproducts of coke and cracking residue.

25. A multi-step process operated to catalytically produce hydrocarbons from porous and permeable hydrocarbon bearing earth strata wherein the process utilizes at least one injection well and at least one production well both completed in the same hydrocarbon bearing porous and permeable earth strata through which is established a flow direction of injection gas, hydrocarbon cracking catalyst and freed hydrocarbons through said strata from injection well to said production well, and including the steps of:

1. introducing heated inert gas under pressure into and through said injection well and into said strata for preheating said strata;
2. start adding hydrocarbon cracking catalyst into the hot inert gas flow to deliver said catalyst into the hydrocarbon bearing strata thereby bringing about catalytic hydrocarbon cracking within said strata to crack larger immobile hydrocarbon molecules into smaller more mobile hydrocarbon molecules;
3. shutting down addition of cracking catalyst to injection gas while continuing the flow of hot, pressurized inert gas into and through said injection well and into said strata stripping deactivated catalyst of volatile hydrocarbons;
4. raising the $O_2$ content of said heated and pressurized injection gas to bring about catalyst regeneration, catalyst regeneration occurs by burning the coke from the deactivated catalyst when the oxygen content of the gas contacting the deactivated catalyst is sufficiently high to bring about the burning of the coke deposited on the catalyst and to burn the cracking residue binding said catalyst to the pore surfaces of said strata thereby freeing the regenerated catalyst to enter the gas flow stream thereby advancing the hydrocarbon cracking front through said strata toward the production well; and
5. repeating said steps of catalytic cracking (2), catalyst stripping (3) and catalyst regeneration (4) to advance the catalytic hydrocarbon cracking front through said strata toward said production well, whereby said cycling of said $O_2$ and catalyst content of said heated and pressurized injection gas flow, strata to promote and advance continued catalytic cracking of said hydrocarbons in said strata and regeneration of said deactivated catalyst therein and provide a pressurized gas sweep which drives said freed cracked hydrocarbons and a portion of said uncracked hydrocarbons having improved mobility as a result of their absorbing heat, cracked hydrocarbons and $CO_2$ through said strata toward and into said production well.

26. A multi-step process operated to catalytically produce hydrocarbons from porous and permeable hydrocarbon bearing earth strata wherein the process utilizes at least one injection well equipped with an ignitor and slotted section of tubing opposing said strata and at least one production well both completed in said hydrocarbon bearing porous and permeable earth strata through which is established a flow direction of injection gas, hydrocarbon cracking catalyst and freed hydrocarbons through said strata from injection well to said production well, including the steps of:

1. introducing $O_2$ containing heated gas and fuel gas under pressure into and through said injection well and into said strata preparatory to igniting the hydrocarbons in said strata;
2. activating said ignitor to ignite the fuel gas to burn through said slotted section of tubing to bring about combustion of said hydrocarbons in said strata adjacent thereto;
3. shutting down fuel gas supply and continuing heated and pressurized $O_2$ containing gas flow into said strata;
4. start adding hydrocarbon cracking catalyst into the $O_2$ containing gas to deliver said catalyst into the hydrocarbon bearing strata thereby bringing about catalytic hydrocarbon cracking within said strata to crack larger immobile hydrocarbon molecules into smaller more mobile hydrocarbon molecules;
5. shutting down addition of cracking catalyst and reduce $O_2$ content of injection gas, thereby introducing a flow of hot, pressurized inert gas into and through said injection well and into said strata stripping deactivated catalyst of volatile hydrocarbons;
6. raising the $O_2$ content of the heated and pressurized injection gas so as to bring about catalyst regeneration, catalyst regeneration occurs by burning the coke from said deactivated catalyst when the oxygen content of the gas contacting said deactivated catalyst is sufficiently high to bring about the burning of said coke deposited on the catalyst and to burn the cracking residue binding the catalyst to the pore surfaces of said strata thereby freeing the regenerated catalyst to enter the gas flow stream thereby advancing the hydrocarbon cracking front through said strata toward the production well;
7. reducing $O_2$ content of heated injection gas and start adding hydrocarbon cracking catalyst to injection gas to catalytically crack hydrocarbons within said strata; and
8. repeating said steps of catalyst stripping (5), catalyst regeneration (6) and catalytic cracking (7) to advance the catalytic hydrocarbon cracking front through said strata toward said production well, whereby said cycling of said $O_2$ and catalyst content of heated and pressurized injection gas flow, controlled to maintain suitable temperature in said strata to promote and advance continued catalytic cracking of said hydrocarbons in said strata and regeneration of said deactivated catalyst therein and to provide a pressurized gas sweep which drives freed cracked hydrocarbons and a portion of said uncracked hydrocarbons having improved mobility as a result of their absorbing heat, cracked hydrocarbons and $CO_2$ through said strata toward and into said production well.

27. A multi-step process operated to catalytically produce hydrocarbons from porous and permeable hydrocarbon bearing earth strata wherein the process utilizes at least one injection well and at least one production well both completed in the same hydrocarbon bearing porous and permeable earth strata through which is established a flow direction of injection gas, hydrocarbon cracking catalyst and freed hydrocarbons through said strata from injection well to said production well, including the steps of:

1. introducing heated inert gas under pressure into and through said injection well and into said strata for heating said strata;
2. shutting down inert gas supply and starting heated and pressurized $O_2$ containing gas flow into said strata;
3. start adding hydrocarbon cracking catalyst into the $O_2$ containing gas to deliver said catalyst into the hydrocarbon bearing strata thereby bringing about catalytic hydrocarbon cracking within the strata to crack larger immobile hydrocarbon molecules into smaller more mobile hydrocarbon molecules;
4. shutting down addition of cracking catalyst and reducing $O_2$ content of injection gas, thereby introducing a flow of hot, pressurized inert gas into and through said injection well and into said strata stripping deactivated catalyst of volatile hydrocarbons;
5. raising the $O_2$ content of the heated and pressurized injection gas to bring about catalyst regeneration, catalyst regeneration occurs by burning the coke from the deactivated catalyst when the oxygen content of the gas contacting said deactivated catalyst is sufficiently high to bring about the burning of the coke deposited on the catalyst and to burn the cracking residue binding the catalyst to the pore surfaces of said strata thereby freeing the regenerated catalyst to enter the gas flow stream thereby advancing the hydrocarbon cracking front through the strata toward the production well;
6. reducing $O_2$ content of heated injection gas and start adding hydrocarbon cracking catalyst to injection gas to catalytically crack hydrocarbons within said strata; and
7. repeating said steps of catalyst stripping (4), catalyst regeneration (5) and catalytic cracking (6) to advance the catalytic hydrocarbon cracking front through said strata toward said production well, whereby said cycling of said $O_2$ and catalyst content of said heated and pressurized injection gas flow, controlled to maintain suitable temperature in said strata to promote and advance continued catalytic cracking of said hydrocarbons in said strata and regeneration of said deactivated catalyst therein and to provide a pressurized gas sweep which drives said freed cracked hydrocarbons and a portion of said uncracked hydrocarbons having improved mobility as a result of their absorbing heat, cracked hydrocarbons and $CO_2$ through said strata toward and into said production well.

28. A multi-step process operated to catalytically produce hydrocarbons from porous and permeable hydrocarbon bearing earth strata wherein the process utilizes at least one injection well and at least one production well both completed in the same hydrocarbon bearing porous and permeable earth through which is established a flow direction of injection gas, hydrocarbon cracking catalyst and freed hydrocarbons through said strata from injection well to said production well, including the steps of:

1. introducing $O_2$ containing heated gas under pressure into and through said injection well and into said strata for purpose of spontaneously igniting the hydrocarbons in said strata;
2. start adding hydrocarbon cracking catalyst into the $O_2$ containing gas flow to deliver said catalyst into said hydrocarbon bearing strata thereby bringing about catalytic hydrocarbon cracking within said strata to crack larger immobile hydrocarbon molecules into smaller more mobile hydrocarbon molecules;
3. shutting down addition of cracking catalyst and reduce $O_2$ content of injection gas, thereby introducing a flow of hot, pressurized inert gas into and through said injection well and into said strata stripping deactivated catalyst of volatile hydrocarbons;
4. raising the $O_2$ content of the heated and pressurized injection gas to bring about catalyst regeneration, catalyst regeneration occurs by burning the coke from the deactivated catalyst when the oxygen content of the gas contacting said deactivated catalyst is sufficiently high to bring about the burning of the coke deposited on said deactivated catalyst and to burn the cracking residue binding said deactivated catalyst to the pore surfaces of said strata thereby freeing the regenerated catalyst to enter the gas flow stream thereby advancing the hydrocarbon cracking front through said strata toward said production well;
5. reducing $O_2$ content of heated injection gas and start adding hydrocarbon cracking catalyst to injection gas to catalytically crack hydrocarbons within said strata, and
6. repeating the said steps of catalyst stripping (3), catalyst regeneration (4) and catalytic cracking (5) to advance the catalytic hydrocarbon cracking front through said strata toward said production well, whereby said cycling of said $O_2$ and catalyst content of said heated and pressurized injection gas flow, controlled to maintain suitable temperature in said strata to promote and advance continued catalytic cracking of said hydrocarbons in said strata and regeneration of said deactivated catalyst therein and to provide a pressurized gas sweep which drives said freed cracked hydrocarbons and a portion of said uncracked hydrocarbons having improved mobility as a result of their absorbing heat, cracked hydrocarbons and $CO_2$ through said strata toward and into said production well.

29. A multi-step process operated to catalytically produce hydrocarbons from porous and permeable hydrocarbon bearing earth strata wherein the process utilizes at least one injection well equipped with an ignitor and slotted tubing section opposing said strata and at least one production well both completed in said hydrocarbon bearing porous and permeable earth strata through which is established a flow direction of injection gas, hydrocarbon cracking catalyst and freed hydrocarbons through said strata from injection well to said production well including the steps of:

1. introducing heated inert gas under pressure into and through said injection well and into said strata for preheating said strata;
2. introducing $O_2$ containing heated gas and fuel gas under pressure into and through said injection well and into said strata preparatory to igniting the hydrocarbons in said strata;
3. activating the ignitor to ignite the fuel gas to burn through said slotted section of tubing to bring about combustion of the hydrocarbons in the strata adjacent thereto;
4. shutting down the fuel gas supply and continuing the heated and pressurized $O_2$ containing gas flow into said strata;
5. start adding hydrocarbon cracking catalyst into the $O_2$ containing gas to deliver said catalyst into the hydrocarbon bearing strata thereby bringing about catalytic hydrocarbon cracking within the strata to crack larger immobile hydrocarbon molecules into smaller more mobile hydrocarbon molecules;
6. shutting down addition of said cracking catalyst and reducing $O_2$ content of injection gas, thereby introducing a flow of hot, pressurized inert gas into and through said injection well and into said strata stripping deactivated catalyst of volatile hydrocarbons;
7. raising the $O_2$ content of the heated and pressurized injection gas so as to bring about catalyst regeneration, catalyst regeneration occurs by burning the coke from the deactivated catalyst when the oxygen content of the gas contacting the deactivated catalyst is sufficiently high to bring about the burning of the coke deposited on the catalyst and to burn the cracking residue binding the catalyst to the pore surface of said strata thereby freeing said regenerated catalyst to enter the gas flow stream thereby advancing the hydrocarbon cracking front through the strata toward production well;
8. reducing $O_2$ content of heated injection gas and start adding hydrocarbon cracking catalyst to catalytically crack hydrocarbons within said strata; and
9. repeating said steps of catalyst stripping (6), catalyst regeneration (7) and catalytic cracking (8) to advance the catalytic hydrocarbon cracking front through said strata toward said production well, whereby said cycling of said $O_2$ and catalyst content of heated and pressurized injection gas flow, controlled to maintain suitable temperature in said strata to promote and advance continued catalytic cracking of said hydrocarbons in said strata and regeneration of said deactivated catalyst therein and to provide a pressurized gas sweep which drives said freed cracked hydrocarbons and a portion of said uncracked hydrocarbons having improved mobility as a result of their absorbing heat, cracked hydrocarbons, and $CO_2$ through said strata toward and into said production well.

30. A multi-step process for catalytically producing hydrocarbons from porous and permeable hydrocarbon bearing earth strata wherein the process utilizes at least one injection well and one production well completed in said strata through which is established a flow direction of injection gas, hydrocarbon cracking catalyst and freed hydrocarbons from said injection well to said production well and in said strata is established a catalytic hydrocarbon cracking zone, including steps of injecting into said strata said hot injection gas and said hydrocarbon cracking catalyst sized sufficiently small whereby the terminal velocity of said finely divided catalyst particles is less than the velocity of the injection gas flowing through the porous and permeable hydrocarbon strata.

31. A multi-step process of catalytically producing hydrocarbons from porous and permeable hydrocarbon bearing earth strata wherein the process utilizes at least one injection well and one production well completed in said strata through which is established a flow direction of injection gas, hydrocarbon cracking catalyst and freed hydrocarbons from said injection well to said production well and in said strata is established a catalytic hydrocarbon cracking zone, including steps of injecting into said strata said hot injection gas and said hydrocarbon cracking catalyst sized sufficiently small thereby allowing said catalyst particles to freely flow through the pores of the hydrocarbon bearing porous and permeable strata when transported by the injection fluid.

32. A multi-step process for catalytically producing hydrocarbons from porous and permeable hydrocarbon bearing earth strata wherein the process utilizes at least one injection well and one production well completed in said strata through which is established a flow direction of injection gas, hydrocarbon cracking catalyst and freed hydrocarbons from said injection well to said production well and in said strata is established a catalytic hydrocarbon cracking zone, including steps of injecting into said strata said hot injection gas and said hydrocarbon cracking catalyst material having hydrocarbon cracking activity and capable of being regenerated with hot $O_2$ containing gas by burning the deactivating deposits of coke which are formed on the catalyst surfaces as a coproduct in the hydrocarbon cracking reaction.

33. A multi-step process for catalytically producing hydrocarbons from porous and permeable hydrocarbon bearing earth strata wherein the process utilizes at least one injection well and one production well completed in said strata through which is established a flow direction of injection gas, hydrocarbon cracking catalyst and freed hydrocarbons from said injection well to said production well and in said strata is established a catalytic hydrocarbon cracking zone, including steps of injecting into said strata said hot injection gas and said hydrocarbon cracking catalyst that is any of the catalyst varieties consisting of silica and alumina conventionally employed in fluid catalytic cracking units of the petroleum refining industry.

34. A multi-step process for catalytically producing hydrocarbon from porous and permeable hydrocarbon bearing earth strata in which is established a catalytic hydrocarbon cracking zone wherein the process utilizes at least one injection well equipped with atmospheric vent and one production well completed in said hydrocarbon bearing strata through which is established a flow direction of injection gas, hydrocarbon cracking catalyst and freed hydrocarbons through said strata from injection well to production well including the steps of:

1. Shutting down injection of hydrocarbon cracking catalyst into injection gas
2. shutting down flow of injection gas,
3. venting the injection well thereby causing the flow direction through the hydrocarbon strata to reverse and flow through thestrata from the strata well to injection well for a short duration of time, and
4. closing said injection well vent and resuming flow of injection gas
5. resuming injection of hydrocarbon cracking catalyst to said strata via said injection well, thereby relieving any plugging or blockage which may be experienced in said strata during the operation of this process.

* * * * *